US010959511B2

(12) United States Patent
Trudeau

(10) Patent No.: US 10,959,511 B2
(45) Date of Patent: Mar. 30, 2021

(54) PORTABLE FOAM BRUSH

(71) Applicant: Leon Trudeau, Brossard, LA (US)

(72) Inventor: Leon Trudeau, Brossard, LA (US)

( * ) Notice: Subject to any disclaimer, the term of this patent is extended or adjusted under 35 U.S.C. 154(b) by 2 days.

(21) Appl. No.: 16/320,151

(22) PCT Filed: Jul. 26, 2017

(86) PCT No.: PCT/US2017/043944
§ 371 (c)(1),
(2) Date: Jan. 24, 2019

(87) PCT Pub. No.: WO2018/022753
PCT Pub. Date: Feb. 1, 2018

(65) Prior Publication Data

US 2019/0231061 A1 Aug. 1, 2019

Related U.S. Application Data

(60) Provisional application No. 62/445,810, filed on Jan. 13, 2017, provisional application No. 62/366,944, filed on Jul. 26, 2016.

(51) Int. Cl.
*A46B 11/00* (2006.01)
*A46B 11/06* (2006.01)
(Continued)

(52) U.S. Cl.
CPC ..... *A46B 11/0017* (2013.01); *A46B 11/00* (2013.01); *A46B 11/06* (2013.01);
(Continued)

(58) Field of Classification Search
CPC ..... A46B 11/0017; A46B 11/06; A46B 11/00; A46B 2200/3033; A46B 11/001;
(Continued)

(56) References Cited

U.S. PATENT DOCUMENTS 3,178,756 A 4/1965 Ballantyne
3,751,755 A * 8/1973 Smith ..... A47L 11/4044 15/302

(Continued)

FOREIGN PATENT DOCUMENTS

EP 0083810 A2 7/1983

OTHER PUBLICATIONS

International Search Report and Written Opinion for PCT/US2017/043944 dated Dec. 22, 2017 (11 Pages).

(Continued)

*Primary Examiner* — David J Walczak
(74) *Attorney, Agent, or Firm* — Fitch, Even, Tabin & Flannery, LLP

(57) ABSTRACT

A portable foam brush includes a soap reservoir, such as optionally in a base or in a wand, a foaming chamber, and an air compressor, such as optionally battery-operated air compressor. The compressor is configured for supplying air to act upon the soap from the reservoir to cause dispensing of soap to the foaming chamber. In some embodiments, the compressor may also supply air to the foaming chamber. In use, the soap and the air in the foaming chamber combine to form an air and soap foam. The brush includes a brush end configured for receiving foam from the foaming chamber and dispensing the foam.

18 Claims, 23 Drawing Sheets

(51) Int. Cl.

| | |
|---|---|
| ***B01F 5/04*** | (2006.01) |
| ***B01F 5/06*** | (2006.01) |
| ***B01F 15/04*** | (2006.01) |
| ***B01F 3/04*** | (2006.01) |

(52) U.S. Cl.
CPC ..... *B01F 3/04446* (2013.01); *B01F 3/04992* (2013.01); *B01F 5/0496* (2013.01); *B01F 5/0653* (2013.01); *B01F 15/047* (2013.01); *A46B 11/002* (2013.01); *A46B 11/0062* (2013.01); *A46B 2200/3033* (2013.01)

(58) Field of Classification Search
CPC ..... A46B 11/002; A46B 11/0062; A46B 11/0072; A46B 11/066; B01F 5/0496; B01F 5/0653; B01F 5/0498; B01F 15/0462; B01F 15/047; B01F 3/04446; B01F 3/04992
See application file for complete search history.

(56) References Cited

U.S. PATENT DOCUMENTS

| | | | | |
|---|---|---|---|---|
| 4,030,665 | A | 6/1977 | Koyama | |
| 4,383,935 | A * | 5/1983 | Hull | B01F 13/10 261/78.1 |
| 4,575,270 | A | 3/1986 | Hammond | |
| 4,640,440 | A | 2/1987 | Ford, Jr. et al. | |
| 4,974,618 | A * | 12/1990 | Nysted | A47L 11/34 134/21 |
| 5,695,293 | A * | 12/1997 | Chase | A46B 11/066 401/283 |
| 7,631,386 | B1 | 12/2009 | Santiago et al. | |
| 2016/0157596 | A1 | 6/2016 | Fifield | |

OTHER PUBLICATIONS

Extended European Search Report for corresponding EP Application No. 17835205 dated Jan. 31, 2020 (9 pages).

* cited by examiner

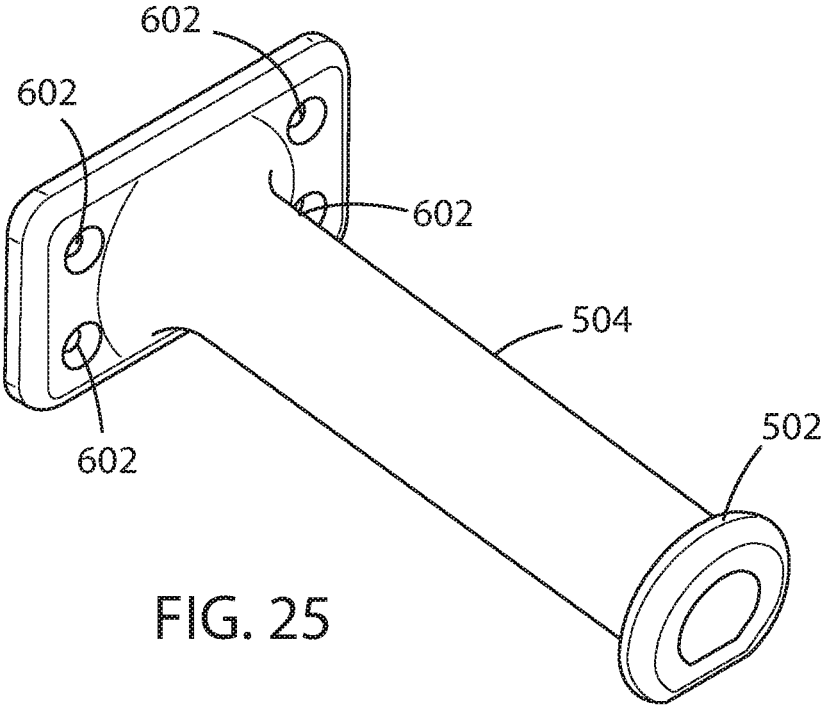
FIG. 25
FIG. 26
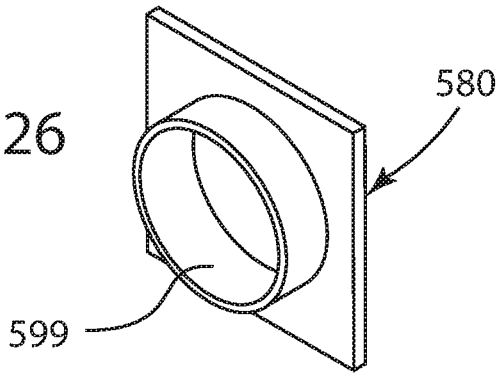

FIG. 40
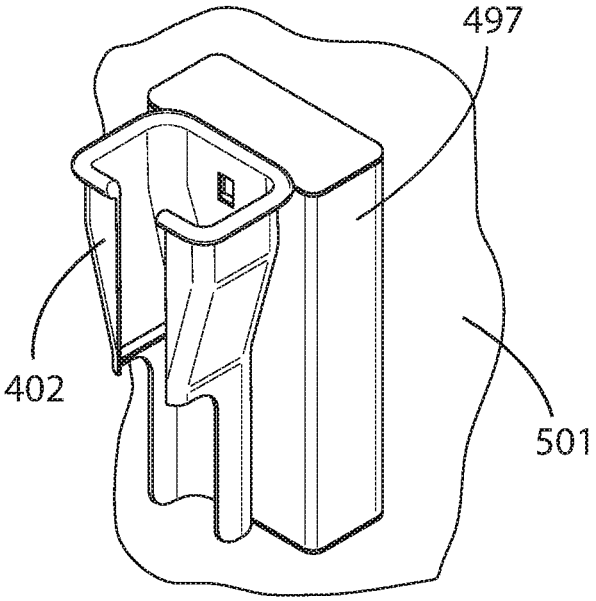
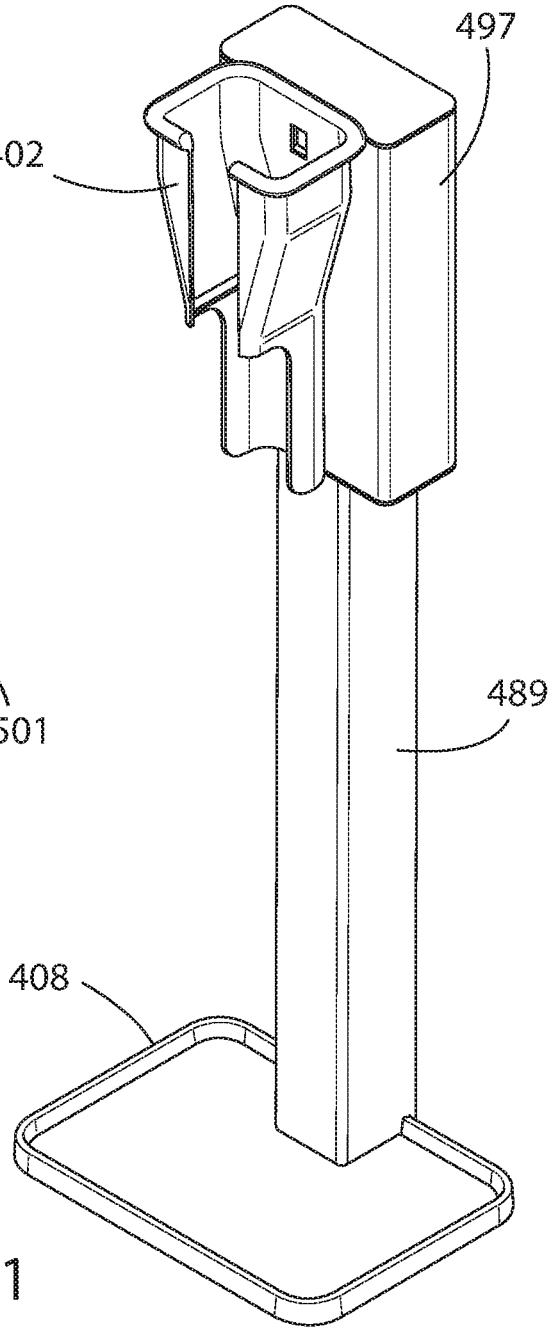
FIG. 41

PORTABLE FOAM BRUSH

CROSS-REFERENCE TO RELATED APPLICATIONS

This application is a U.S. national phase application filed under 35 U.S.C. § 371 of International Application No. PCT/US2017/043944, filed Jul. 26, 2017, designating the United States, which claims priority from U.S. Provisional Application Ser. No. 62/366,944 filed Jul. 26, 2016, and from U.S. Provisional Application Ser. No. 62/445,810 filed Jan. 13, 2017, the content of each which are incorporated herein by reference in their entirety for all purposes.

FIELD

Foam brushes are described herein and, in particular, foam brushes configured for portable use with a soap reservoir disposed in a base or a foam brush wand.

BACKGROUND

Foam brushes generate and dispense foam for use in cleaning, such as cleaning of building exteriors and vehicles, including automobiles, boats, and campers. Foam brushes can be used to apply foam during scrubbing of surfaces of the vehicles. The foam is generated by mixing air and soap. The foam and dirt can then subsequently be removed using a pressure washer.

In self-service and commercial car washes foam brushes are often attached using a hose to a source of soap and air. This hose attachment can render the foam brush cumbersome to use. For example, the hose can drag across the floor of the washing bay, picking up grit and other debris, which can then undesirably transfer to the vehicle upon contact. Yet another disadvantage of the use of hose-tethered foam brushes is that the hose can limit the mobility of the foam brush, such as in reaching certain locations on a vehicle. For instance, the hose can become pinched under wheels, or require a user to work in certain orientations.

SUMMARY

Advantageously, a portable foam brush is provided that is configured for use in cleaning without requiring tethering via a cord or hose for electrical and/or fluid supply. The portable foam brush wand can include a rechargeable battery for powering the wand and a reservoir for soap. More specifically, the portable foam brush can include a soap reservoir, a foaming chamber, and a battery-operated air compressor. The compressor can also be configured for supplying air to act upon the soap reservoir to cause dispensing of soap from the soap reservoir to the foaming chamber. The compressor can also be also configured to independently supply air to the foaming chamber. In use, the soap and the air in the foaming chamber combine to form a foam. The brush can include a brush end configured for receiving foam from the foaming chamber and dispensing the foam.

In one aspect, the soap reservoir has a movable piston dividing the reservoir into a chamber for containing soap and an actuation chamber. The actuation chamber is configured to be acted upon by air from the air compressor for moving the piston to decrease the size of the chamber for containing soap to dispense soap from that chamber.

In another aspect, the air compressor supplies air to act upon the soap reservoir via a soap reservoir air path. The air compressor also supplies air to the foaming chamber via a foaming chamber air path. The soap reservoir and foaming chamber air paths can have portions that are independent. The foaming chamber air path can be disposed exteriorly of the soap reservoir, or, in another form, the foaming chamber air path can have a segment extending through the soap reservoir and, in a specific form, a segment of the foaming chamber air path extends at least in part in a conduit extending through the chamber for containing soap and the actuation chamber and can extend through an aperture in the moveable piston. The foam chamber air path may include an adjustment valve for adjusting the amount of air delivered to the foaming chamber.

In yet another aspect, a soap reservoir filling valve assembly is provided between the soap reservoir and the foaming chamber. The soap reservoir filling valve assembly has a filling mode, whereby soap can be introduced into the soap reservoir and is blocked from entering the foaming chamber. The soap reservoir filling valve assembly also has a dispensing mode, whereby soap can be dispensed from the soap reservoir into the foaming chamber. Air flow from the air compressor to the foaming chamber can be blocked when the soap reservoir filling valve assembly is in the filling mode. Conversely, air flow from the air compressor to the foaming chamber can be permitted when the soap reservoir filling valve assembly is in the dispensing mode. The valve can include an air vent with an open position when the soap reservoir filling valve assembly is in the filling mode to permit surplus air to vent from the soap reservoir. The air vent can be in a closed position when the soap reservoir filling valve assembly is in the dispensing mode.

In another aspect, the soap reservoir has a movable piston dividing the reservoir into a chamber for containing soap and an actuation chamber. The actuation chamber can be configured to be acted upon by air from the air compressor for moving the piston to decrease the size of the chamber for containing soap to thereby dispense soap therefrom.

In one aspect, a brush bristle assembly is attached to the brush end for receiving foam from the foaming chamber and dispensing the foam.

In a further aspect, the portable foam brush can be provided or used in combination with a recharging station for recharging of a battery associated with the battery-operated air compressor in order to permit cordless electrical operation of the brush.

In another aspect, the portable foam brush can be provided or used in combination with a soap refilling station configured for filling the soap chamber with soap in order to permit hose-less fluid operation of the brush.

Advantageously, portable foam brush assemblies are provided according to one approach that are configured for use in cleaning and having a soap reservoir disposed in a base.

In one approach, a portable foam brush is provided having the soap reservoir and water supply in a base; the wand having a foaming chamber; a peristaltic pump to act upon the soap reservoir to cause dispensing of soap from the soap reservoir to the foaming chamber in the brush wand and independently supplying air to the foaming chamber whereby, in use, the soap and the air in the foaming chamber combine to form a foam; and a brush attached downstream of the foaming chamber.

In another approach, a portable foam brush assembly is provided that may have a base having a soap supply, a water supply, and an electrical supply, wherein the soap and water are combined therein to a predetermined concentration and delivered to a docked foam brush wand; a foam brush wand having a foaming chamber and a fan motor to drive foam through a wand and out a brush which is attached downstream of the foaming chamber. The soap can be moved from the soap reservoir to the foaming chamber via a peristaltic pump. In one approach, within the base, the soap and water are combined and delivered to the docked foam brush wand by an external water supply regulated to a predetermined pressure, which is activated to mix with the soap delivered via a peristaltic pump by a timer activated by a switch, the pressurized watered being delivered via a solenoid, which is concurrently activated with the pump by the timer.

This Summary is intended to provide a brief overview of some of the subject matter described in this document. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

FIG. 25 is a perspective view of an exemplary approach of the embodiments of the present portable foam brush wand hand grip 504;

FIG. 26 is a perspective view of an exemplary approach of the embodiments of the present portable foam brush first wand section brace 580;

FIG. 40 is a front perspective view of a brush base according to another exemplary approach of the embodiments of the present portable foam brush;

FIG. 41 is a front perspective view of the brush base according to FIG. 40 with and optional base stand.

DETAILED DESCRIPTION

Various embodiments and aspects of a portable foam brush are described herein and illustrated in the exemplary embodiments of FIGS. 1-42. It is noted that any dimensions provided in the figures are for illustrative purposes only and are provided to assist in the understanding of the embodiments. According to one approach, the components of the portable foam brush may include a base, a water supply, an air compressor, a soap reservoir, a foaming chamber, and a brush. According to another approach, the components of the portable foam brush may include a battery operated air compressor, a liquid soap reservoir, a foaming chamber and a brush end. The brush end is adapted for attachment of a bristle assembly for use in brushing. The air compressor supplies air to the soap reservoir to cause soap to enter the foaming chamber. The air compressor also supplies air independently to the foaming chamber for mixing with the soap in the foaming chamber to both form foam and to force the foam from the foaming chamber to the brush end and any bristle or other assembly attached thereto. Advantageously, the portable foam brush is configured for use in cleaning without requiring tethering via a cord or hose for electrical and/or fluid supply. In order words, the portable foam brush is configured to permit cordless operation. To this end, the portable foam brush includes a rechargeable battery for powering the air compressor and/or is configured for refilling of the soap reservoir. Moreover, the air compressor is the sole component that needs to be powered to generate foam, as the air compressor both drives the soap from the soap reservoir and provides air to mix with the soap.

Any of the embodiments described herein can be modified so that the soap reservoir is outboard instead of onboard the pressure wand. That is, the soap reservoir can be separate from the foam brush. Advantageously, this can make the foam brush lighter and is particularly suited for applications where the soap reservoir can be conveniently located nearby to where the foam brush will be used. For example, the soap reservoir can be mounted to the wall of a garage or to a bay of a car wash or disposed in a base or stand to dock a pressure wand.

Figure 1:
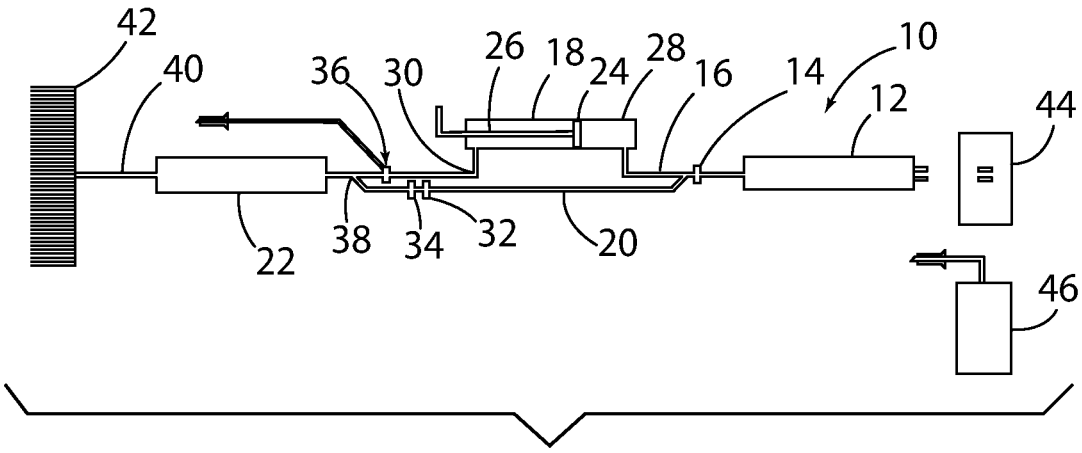
FIG. 1 is a diagrammatic configuration of a first embodiment of a portable foam brush, including an air compressor, a soap reservoir, a soap reservoir filling valve, a foaming chamber, and a brush end, as well as a docking station.
Figure 2:
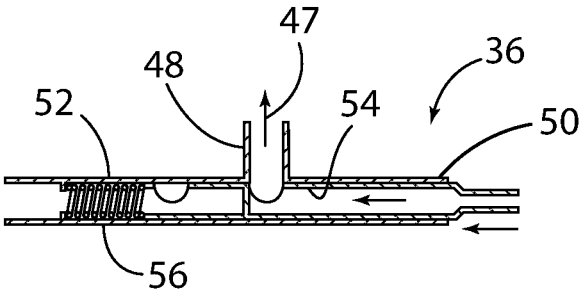
FIG. 2 is a diagrammatic view of the soap reservoir filling valve of the brush of FIG. 1, showing the valve in a filling mode.
Figure 3:
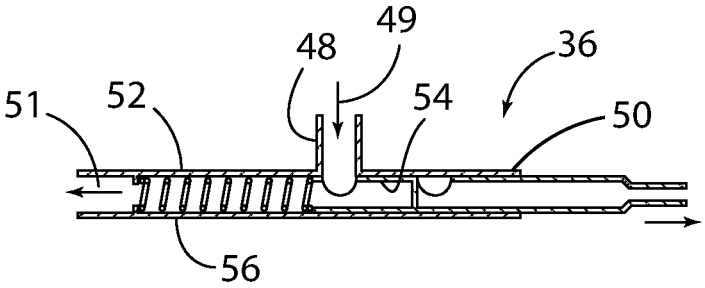
FIG. 3 is a diagrammatic view of the soap reservoir filling valve of the brush of FIG. 1, showing the valve in a dispensing mode.

Turning now to a first exemplary embodiment of a portable foam brush, illustrated in FIGS. 1-3, the portable foam brush 10 includes a battery operated air compressor 12. Air exiting the air compressor 12 first passes a check valve 14 permitting one-way fluid flow only exiting the air compressor 12. Downstream of the check valve 14, air can travel via a first conduit 16 to a soap reservoir 18 and, independently, via a second conduit 20 to a foaming chamber 22. The air compressor 12 can be electrically activated using an actuator, such as a trigger or button.

The soap reservoir 18 is divided by a moveable piston 24 into a chamber for containing soap 26 and an actuation chamber 28. The actuation chamber 28 is in fluid communication with the first conduit 16 such that air from the air compressor 12 enters the actuation chamber 28 and applies a force upon the piston 24. When such force is applied, the piston 24 can move to increase the size of the actuation chamber 28 and thereby decrease the size of the chamber containing soap 26 to thereby force the soap therefrom into a third conduit 30.

The second conduit 20 can optionally include a check valve 32 permitting one-way fluid flow only exiting the second conduit 20. The second conduit 20 can also optionally include an adjustment valve 34, such a needle valve, for adjusting air flow through the second conduit 20 and into the foaming chamber 22.

The third conduit 30 extends between the soap reservoir 18, in particular, the chamber containing soap 26, and the foaming chamber 22. The third conduit includes a soap reservoir filling valve 36 positioned between the soap reservoir 18 and the foaming chamber 22. The soap reservoir filling valve 36 is configured to permit soap to be introduced into the soap reservoir 18 during a filling mode while blocking the soap from entering the foaming chamber 22 during the filling mode. The soap reservoir filling valve 36 is also configured to permit soap to be dispensed from the soap reservoir 18 and into the foaming chamber 22 during a dispensing mode. Further details of the soap reservoir filling valve 36 will be described herein.

The foaming chamber 22 is fed by a merged segment 38 of the second and third conduits 20 and 30, with the third conduit 30 supplying soap from the chamber containing soap 26 and second conduit 20 supplying air from the air compressor 12. The merged air and soap flow enters the foaming chamber 22 and then, due to the much larger cross section of the foaming chamber 22 as compared to the merged segment 38, expands to create an air and soap foam. The foam is then driven out by air pressure to the brush end 40, whereby an assembly, such as a bristle assembly 42, can be attached.

A recharging station 44 and a soap filling station 46, as illustrated in FIG. 1, which can be the same or separate, are provided for use with the portable foam brush 10. The recharging station 44 is configured for recharging a battery of the portable foam brush 10 for powering the air compressor 12. The recharging station 44 can be electrically connected to the battery of the portable foam brush 10 for recharging when the brush is not in use. The soap filling station 46 is configured for filling the soap reservoir 18 and, in particular, the chamber for containing soap 26 using the soap reservoir filling valve 36. The portable foam brush 10 can be fluidly connected to the soap filling station 46 when necessary to fill or refill the soap reservoir 18.

The soap reservoir filling valve 36, as previously mentioned, is positioned between the soap reservoir 18 and the foaming chamber 22 and is used in filling the soap reservoir 18. With reference to the exemplary embodiment of FIGS. 2 and 3, the valve 36 includes a two-way conduit 48 into and out of the soap containing chamber 26 of the soap reservoir 18, an inlet 50 for soap from an external source, such as the soap filling station 46, and an outlet 52 to the third conduit 30 in communication with the foaming chamber 22. The inlet 50 and outlet 52 can be arranged in-line, with the two-way conduit 48 intersecting the inlet 50 and outlet 52. A moveable valve member 54 can be positioned for slidable movement within the inlet 50 and outlet 52 between a filling position and a dispensing position. The valve member 54 can optionally be biased toward the dispensing position using a spring 56. When in the filling position, as shown in FIG. 2, the valve member 54 permits soap to flow from the inlet 50 through the two-way conduit 48, through the third conduit 30 and into the soap container chamber 26 of the soap reservoir 18, but blocks flow into the outlet 52. When in the dispensing position, as shown in FIG. 3, the valve member 54 permits soap to flow from the soap containing chamber 26 of the soap reservoir 18 via the third conduit 30, into the two-way conduit 48 and into the outlet 52, while blocking flow through the inlet 50. The valve member 54 can optionally be configured for mechanical, automatic actuation when connected relative to the soap filling station 46.

To use the portable foam brush 10 to discharge a soap and air foam, a user actuates the air compressor 12, such as by depressing a switch, trigger, button or the like. Actuation of the air compressor 12 ultimately causes the foam to be expelled from the brush 10. The steps that take place to cause the foam to be expelled include sending pressurized air from the air compressor 12, through the first fluid conduit 16, to the soap reservoir 18 and, in particular, the actuation chamber 28 of the soap reservoir 18. The pressurized air in the actuation chamber 28 will act to move the piston 24 to decrease the volume of the chamber containing soap 26, disposed on the opposite side of the piston 24 from the actuation chamber 28, thereby causing the soap to exit the soap reservoir 18 via the third conduit 30. Simultaneously, pressurized air travels from the air compressor 12 through the second conduit 20 toward the mixing chamber 22. More specifically, the air and the soap mix in the merged segment 38 of the second and third conduits 20 and 30 upstream of the foaming chamber 22. The merged air and soap flow enters the foaming chamber 22 and then, due to the much larger cross section of the foaming chamber 22 as compared to the merged segment 38, expands to create the air and soap foam. The foam is then driven out by air pressure to the brush end 40 and any attachment 42 thereon.

Turning now to a second exemplary embodiment of a portable foam brush, and variations thereof, illustrated in FIGS. 4-13, like the prior embodiment the portable foam brush 100 includes a battery operated air compressor F2, a soap reservoir 118, a foaming chamber 122, a first conduit 116 (between the compressor 112 and the soap reservoir 118), a second conduit 120 (between the compressor 112 and the foaming chamber 122) and a soap reservoir filling valve 132. Unlike the prior embodiment, however, the portable foam brush 100 of the embodiment of FIGS. 4-13 has a segment of the second conduit 120 disposed within the soap reservoir 118. This advantageously can result in a more compact design, which can be largely cylindrical and incorporated at least partially into a handle form for the foam brush 100, in one example. The cylindrical format can also include a foaming chamber 122 in the handle form. Also unlike the prior embodiment, the soap reservoir filling valve 132 is configured for venting air from the soap reservoir 118 during the filling mode.

Figure 4:
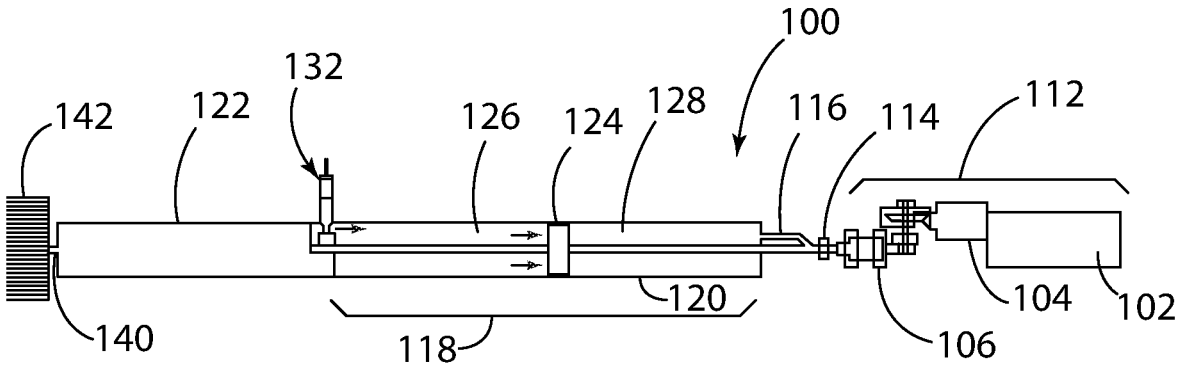
FIG. 4 is a diagrammatic configuration of a second embodiment of a portable foam brush, including an air compressor, a soap reservoir, a soap reservoir, a filling valve assembly, a foaming chamber, and a brush end, showing the brush in a filling mode.
Figure 5:
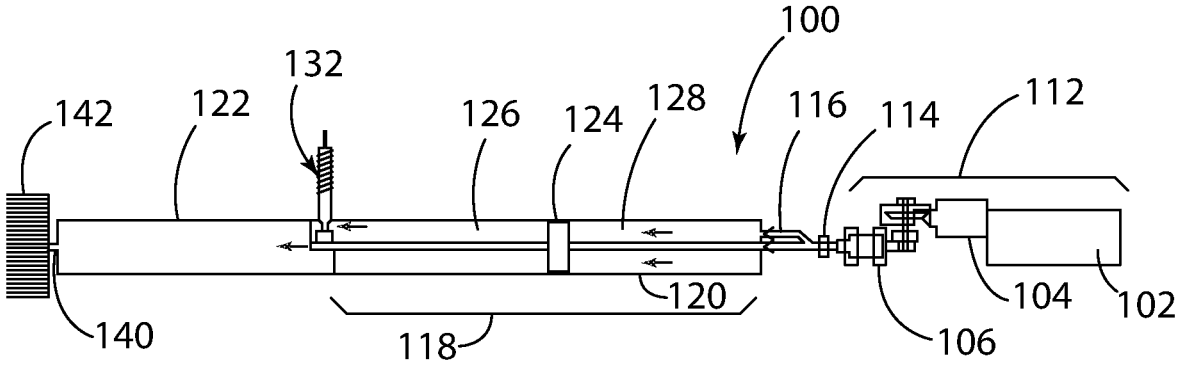
FIG. 5 is a diagrammatic configuration of the foam brush of FIG. 4, showing the brush in a dispensing mode.
Figure 12:
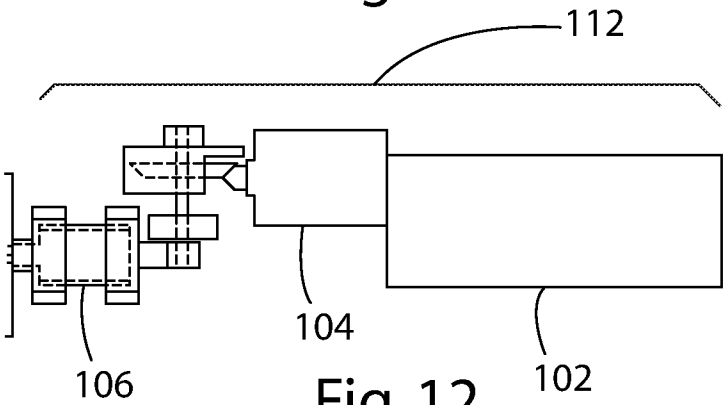
FIG. 12 is a detailed diagrammatic view of the air compressor of the brush of FIGS. 4 and 5.
Figure 14:
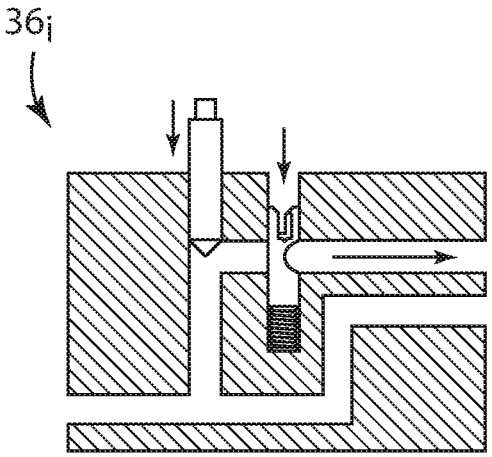
FIG. 14 is a detailed diagrammatic view of an alternative filling valve 36*ii* suitable for use with the brushes described herein, showing the valve in a filling mode.
Figure 15:
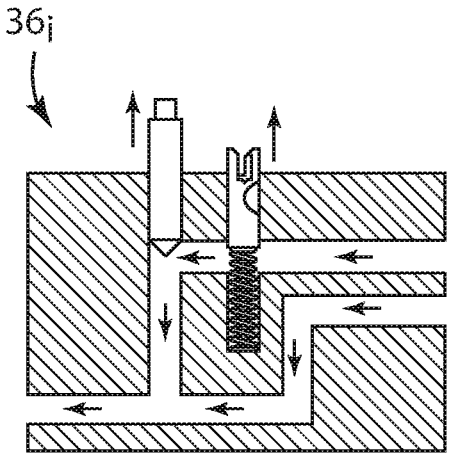
FIG. 15 is a detailed diagrammatic view of the alternative filling valve of FIG. 14, showing the valve in a dispensing mode.
Figure 16:
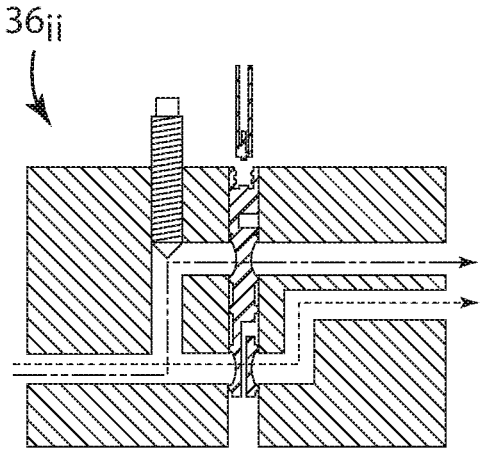
FIG. 16 is a detailed diagrammatic view of yet another alternative filling valve suitable for use with the brushes described herein, showing the valve in a filling mode.
Figure 17:
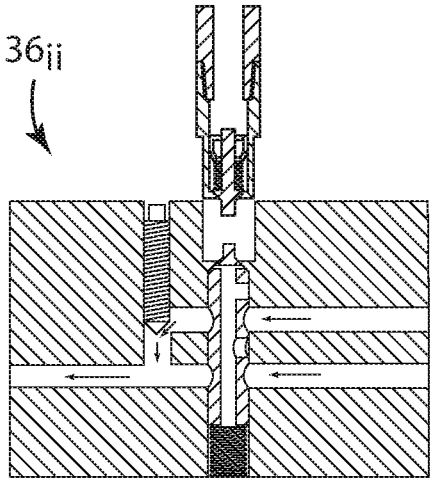
FIG. 17 is a detailed diagrammatic view of the alternative filling valve of FIG. 17, showing the valve in a dispensing mode.

The portable foam brush 100 of the second exemplary embodiment, as shown in FIGS. 4 and 5, includes a handle having an air compressor 112 at one end of a handle and a brush attachment 142 at an opposite end of the handle. Disposed within the handle are the foaming chamber 122 and the soap reservoir 118. The soap reservoir filling valve 132 is disposed on the side of the handle. The air compressor 112 includes a battery 102 powering a motor 104, which in turn causes a piston 106 to reciprocate, as shown in FIG. 12, to generated pressurized air and supply the air to the first and second conduits 116 and 120 downstream of a check valve 114.

Figure 11:
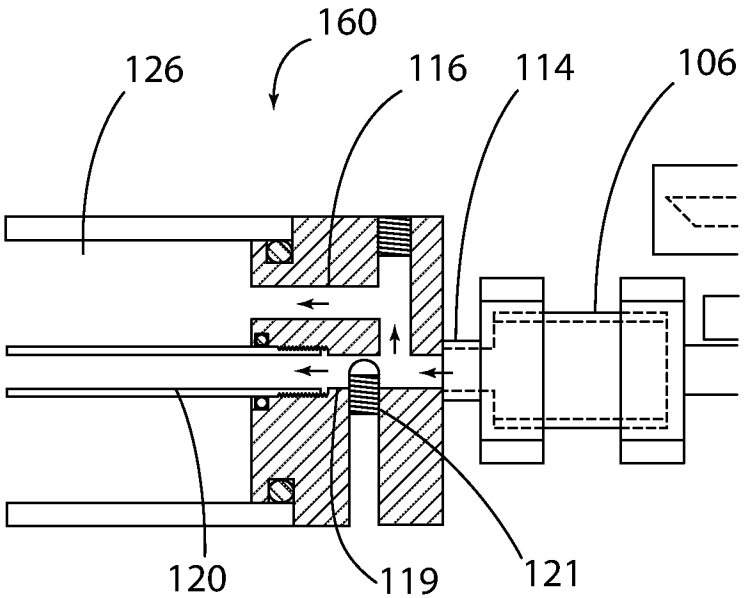
FIG. 11 is a detailed diagrammatic view of the outlet portion of the air compressor of the brush of FIGS. 4 and 5 in the dispensing mode.
Figure 10:
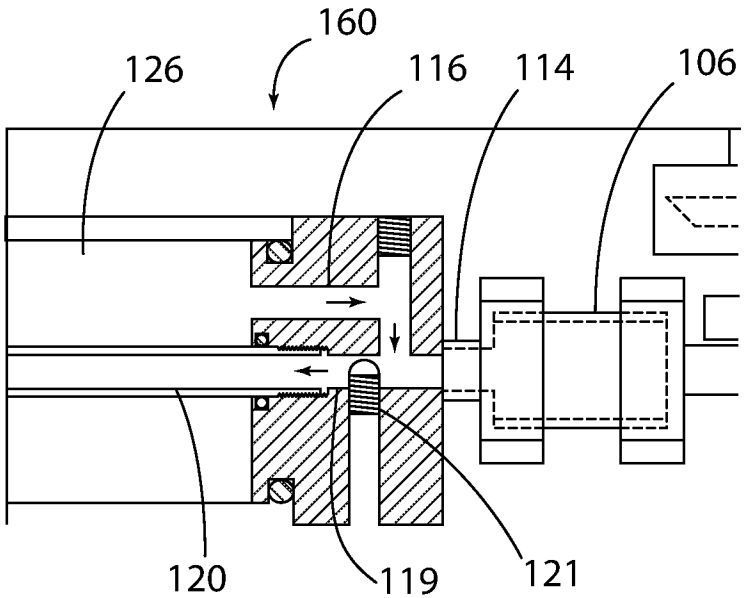
FIG. 10 is a detailed diagrammatic view of an outlet portion of the air compressor of the brush of FIGS. 4 and 5 in the filling mode.

Inlets of the first and second conduits 116 and 120 are arranged within an inlet assembly 160, illustrated in FIGS. 10 and 11. The inlet assembly includes an entrance 119 to the second conduit 120 and, in the illustrated example, the entirety of the first conduit 116. An adjustable valve member 121 can be provided in the entrance 119 to the second conduit 120 to adjust the flow of air into the second conduit 120. That valve member 121 can be a screw or the like that extends into the entrance 119 to the second conduit 120 and can move away or toward an opposing wall to adjust flow. The inlet assembly 160 functions as a primary valve to exhaust air from the backside of the piston 124 during the filling mode.

Figure 7:
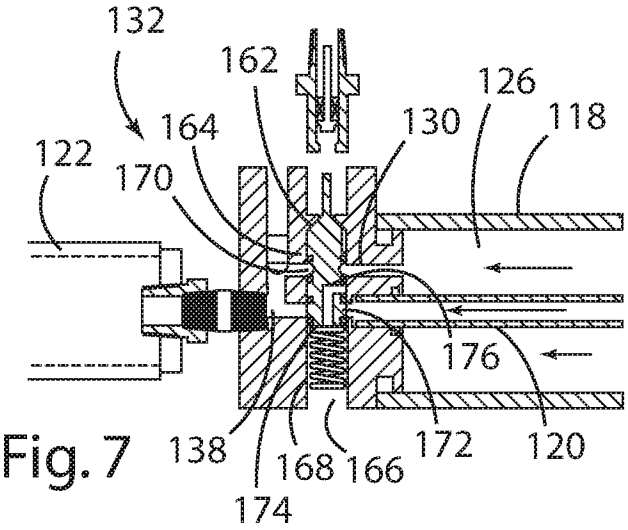
FIG. 7 is a detailed diagrammatic view of the soap reservoir filling valve assembly of FIG. 6, showing the valve assembly in the dispensing mode.
Figure 9:
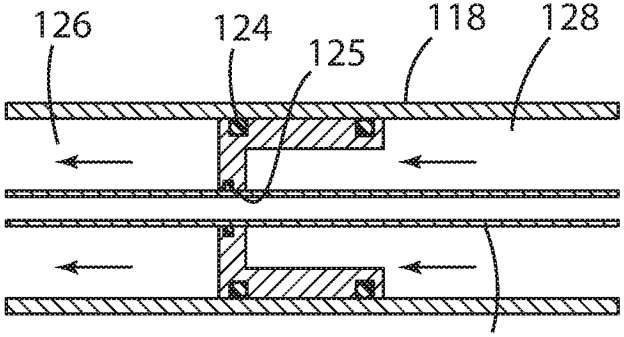
FIG. 9 is a detailed diagrammatic view of a piston of the soap reservoir of the brush of FIGS. 4 and 5 in the dispensing mode.
Figure 6:
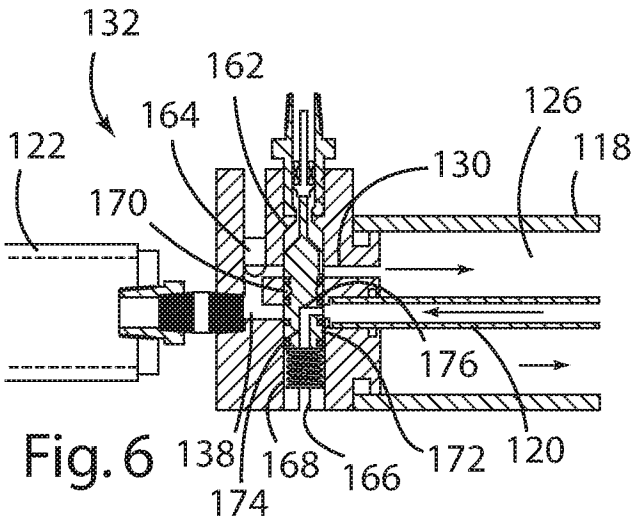
FIG. 6 is a detailed diagrammatic view of an alternative soap reservoir filling valve assembly usable with the brush of FIGS. 4 and 5, showing the valve assembly in the filling mode.
Figure 8:
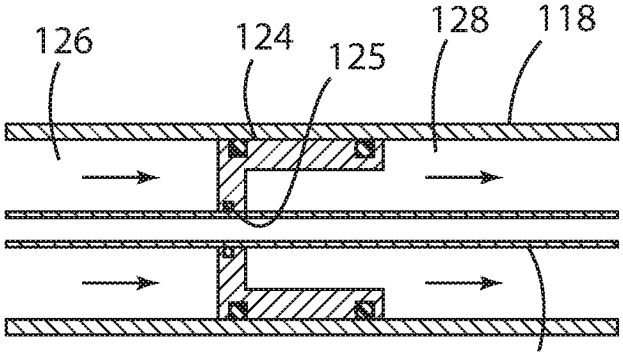
FIG. 8 is a detailed diagrammatic view of a piston of the soap reservoir of the brush of FIGS. 4 and 5 in the filling mode.

The second conduit 120 is supported at its entrance by the inlet assembly 160, as shown in FIGS. 10 and 11, at its exit by the soap reservoir filling valve 132, as shown in FIGS. 6 and 7, and therebetween by the moveable piston 124 of the soap reservoir 118, as shown in FIGS. 8 and 9. More specifically, as in the prior embodiment, the soap reservoir 118 is divided into a soap container chamber 126 and an actuation chamber 128 by the piston 124. In this embodiment, however, the piston 124 has a central aperture 125 through which the second conduit 120 extends. The piston 124 is slidable within the soap reservoir 118 and along the second conduit 120. Optionally, the second conduit 120 is coaxial with the soap reservoir 118. The inlet assembly 160 functions as a primary valve in this arrangement for allowing air from the compressor to act on the piston 124, while also allowing the air to flow through the conduit 120 to mix with the soap in the foam generator make the foam.

An alternative soap reservoir filling valve 132 for use with the second embodiment, illustrated in FIGS. 6 and 7, includes a valve chamber 162 with a moveable valve member 164 disposed therein. This is a combination valve, in that it controls air, soap and foam flow. More specifically, the valve member 164 has a filling position, illustrated in FIG. 6, whereby soap can enter into the soap containing chamber 126 of the soap reservoir 118 and air from the actuation chamber 128 can vent through the second conduit 120 and out an air vent 166 of the soap reservoir filling valve 132. The valve member 164 also has a dispensing position, illustrated in FIG. 7, whereby soap from the soap containing chamber 126 of the soap reservoir 118 and air from the second air conduit 120 are allowed to pass the moveable valve member 164 and combine in a downstream segment 138 before entering the foaming chamber 122, and whereby the air vent 166 is blocked. The valve member 164 can optionally be biased into the dispensing position buy a spring 168.

The moveable valve member 164 has a cylindrical body with an exterior soap dispensing circumferential groove 170 and an exterior air dispensing circumferential groove 172. When the grooves 170 and 172 are aligned with their respective sources, which will occur at the same time, soap and air are allowed to pass the valve member 164. The valve body includes an internal exit bore 174 in communication with a radial infeed bore 176 for venting air to the air vent 166. When the radial infeed bore 176 is aligned with the second conduit 120, air is allowed to exit the second conduit 120 and pass through the bores 174 and 176 to vent. However, when the radial infeed bore 176 is misaligned with the second conduit 120, the exterior air dispensing circumferential groove 172 is aligned with the second conduit 120 so that air can pass the valve member 164 but not vent.

Figure 13:
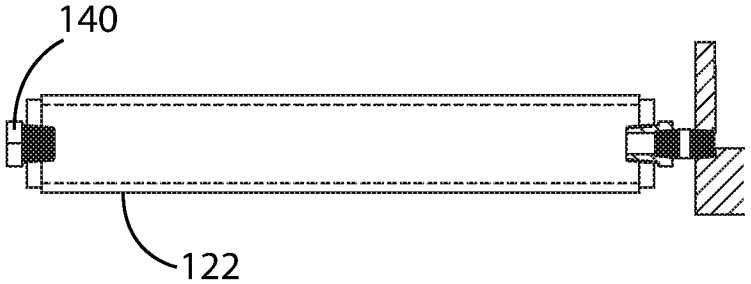
FIG. 13 is a detailed diagrammatic view of the foam generator of the brush of FIGS. 4 and 5.

The foaming chamber 122, illustrated in FIG. 13, has one end attached in fluid communication with the downstream segment 138 of the soap filling valve assembly 132. An opposite end 140 of the foaming chamber 122 is configured for attachment to an assembly such as a bristle assembly, which can be threadingly or otherwise attached.

In operation, the portable foam brush 110 of the second embodiment dispenses foam when the air compressor 112 is actuated. Actuation of the air compressor 112 causes two independent air flows past the inlet assembly 160. As shown in FIG. 11, one path extends into the actuation chamber 128 of the soap reservoir 118 via the first conduit 116 and the other path through the second conduit 120. Air pressure in the actuation chamber 128 causes the piston 124 to move to decrease the volume of the chamber container soap 126, as illustrated in FIG. 9. The soap is then dispensed past the moveable valve member 164 of the soap filling valve assembly 132 and into the foaming chamber 122, as shown in FIG. 7. Air from the second conduit 120 also passes the soap filling valve assembly 132 and into the foaming chamber 122. Conversely, in the filling mode, soap is injected past the soap filling valve assembly 132, as shown in FIG. 6, and into the soap containing chamber 126 of the soap reservoir 118. The injection of soap causes the piston 124 to move to increase the size of the soap containing chamber 126, as shown in FIG. 8, which causes air in the actuation chamber 128 to be expelled therefrom, through the inlet assembly 160 and into the second conduit 120, as shown in FIG. 10, and then through the second conduit 120 and air vent 166, shown in FIG. 6.

The foaming chambers 22 or 122 can optionally contain a material with many loops that can retain soap so that when air is passed through the loops, bubbles result. A material can be in the form of one or more pads, and can be of any suitable shape or size.

Other configurations of soap filling valve assemblies are depicted in FIGS. 14-17. As shown in those figures, the exit path from the soap reservoir can be selectively blocked by a moveable valve member during a filling mode but not during a dispensing mode. Optionally, the same valve member can block or unblock the air exit path for venting purposes.

Figure 18:
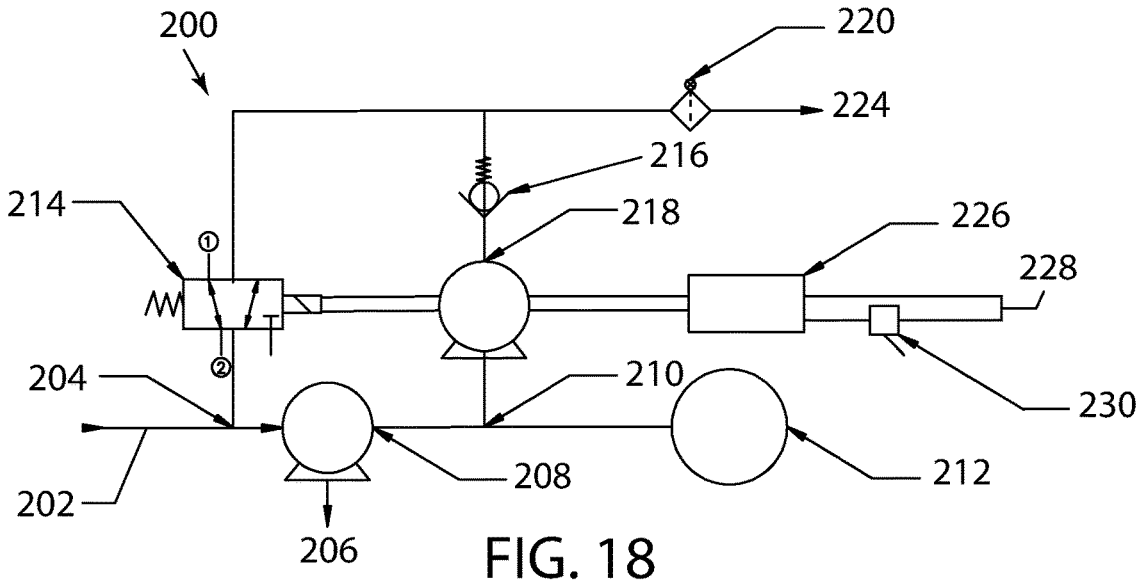
FIG. 18 is a diagrammatic configuration of a schematics of an exemplary approach of the embodiments of the present portable foam brush—compressor washer and bladder.
Figure 19:
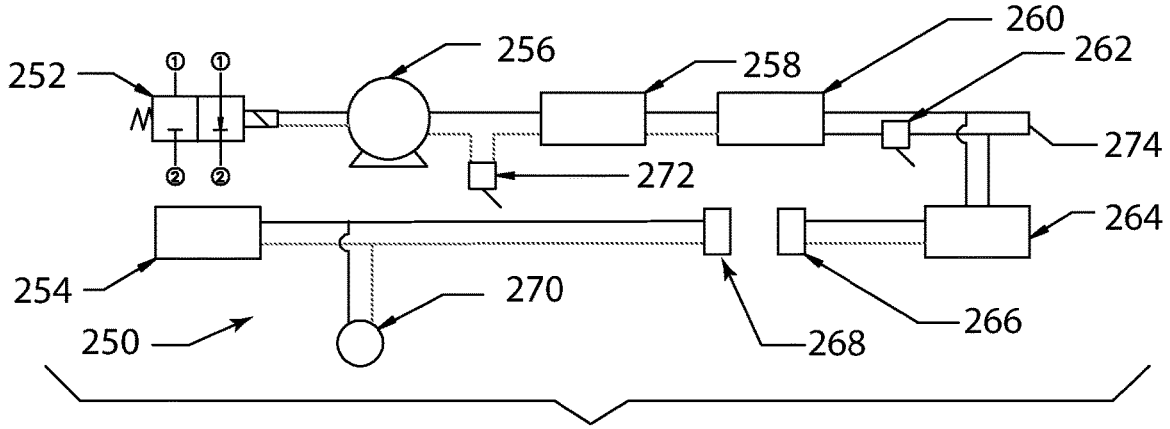
FIG. 19 is a diagrammatic configuration of a schematics of an exemplary approach of the embodiments of the present portable foam brush—home base and pressure washer.
Figure 20:
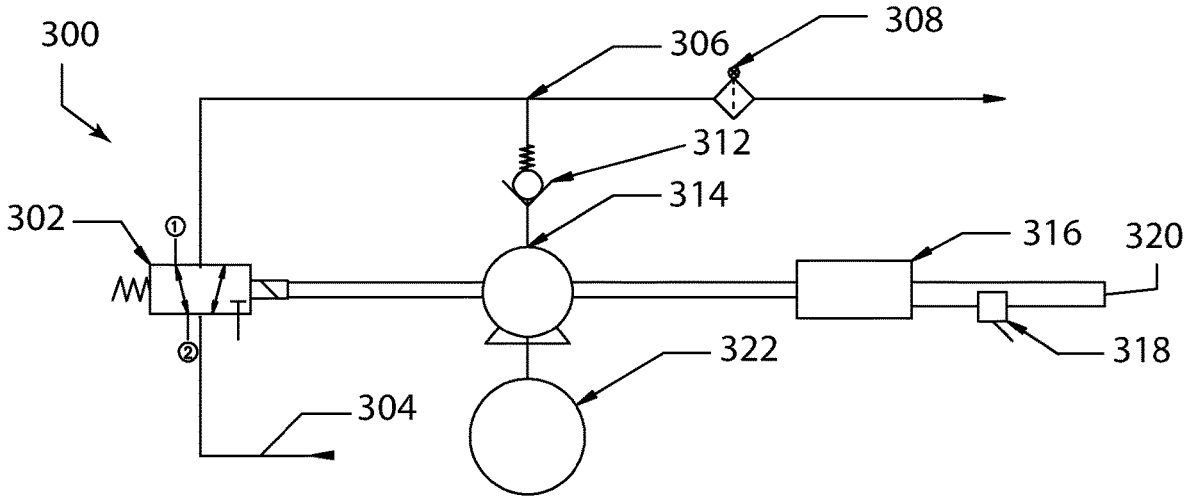
FIG. 20 is a diagrammatic configuration of a schematics of an exemplary approach of the embodiments of the present portable foam brush—home base plumbing schematic.

Turning now to another exemplary embodiment of a portable foam brush, illustrated in FIGS. 18-20, show diagrammatic configurations of a schematics of exemplary approaches of the embodiments of the present portable foam brush.

FIG. 18 illustrates a diagrammatic configuration of a schematic of a compressor washer and bladder of an exemplary approach of the embodiments of the present portable foam brush and is generally indicated at 200. As shown in FIG. 18, water enters the system at a water supply 202, such as a typical garden hose with standard male/female threaded connectors. The water supply can split at tee 204 to a pressure washer pump 208 and then to the pressure washer wand 206. Alternatively, at tee 204, water can be supplied to the soap solenoid valve 214. When the momentary release electric switch 230 is activated and powered by electric power supply 228 (e.g., 110 volt electric power), the timer relay 226 turns on the soap pump 218 and opens a solenoid valve 214 for the water for a programmed period of time (for example 5 to 60 seconds, and preferably about 20 seconds), then shuts off. The passing water mixes with the soap from pressure washer soap reservoir 212 via tee 210 and goes through check valve 216 then filter 220 into a quick coupler in the foam brush 224 to fill the bladder.

FIG. 19 is a diagrammatic configuration of a schematics of an exemplary approach of the embodiments of the present portable foam brush—home base and pressure washer and is generally indicated at 250. As shown, when the relay for the momentary release switch is activated, the timer relay turns on the soap pump and opens an electronic valve for the water for a programed period of time (for example 5 to 60 seconds, and preferably about 20 seconds), then shuts off. Here, the interlock switch prevents the pump and valve from activating if the tool (e.g., the wand) is not docked. Also, a DC battery charger, such as a 12 volt DC battery charger, and an optional battery status light that may be mounted inside the mobile tool (e.g., the wand).

Accordingly, FIG. 19 shows: a 110-Volt incoming power 274, momentary electric release switch 262; timer relay (analog or digital) 260; 110V AC to 12V DC transformer 258; peristaltic soap pump (e.g., 0.15 AMPS) 256; two-way solenoid valve for water (e.g., 0.54 AMPS) 252; battery charge (e.g., 12-V DC for NIMH battery) 264; two pin connector (e.g., male 268 and female 266); battery status light 270; DC battery (e.g., 12-V DC NIMH battery) 254; and interlock switch 272.

FIG. 20 is a diagrammatic configuration of a schematics of an exemplary approach of the embodiments of the present portable foam brush—home base plumbing schematic and generally shown at 300. As shown, when the momentary electric release switch 318 is activated (and powered by 110-V current 320, a timer relay 316 turns on a peristaltic pump for the soap 314 from the soap reservoir 322 and opens a solenoid valve 302 for the water from water supply 304 (such as a garden hose with threaded connection) for a programmed period of time (for example 5 to 60 seconds, and preferably about 20 seconds), then shuts off. The soap passes a check valve 312 and mixes downstream with the water at tee 306, through filter 308 and goes into the foam brush to fill the bladder via a quick coupler 310 in the foam brush wand.

Figure 21:
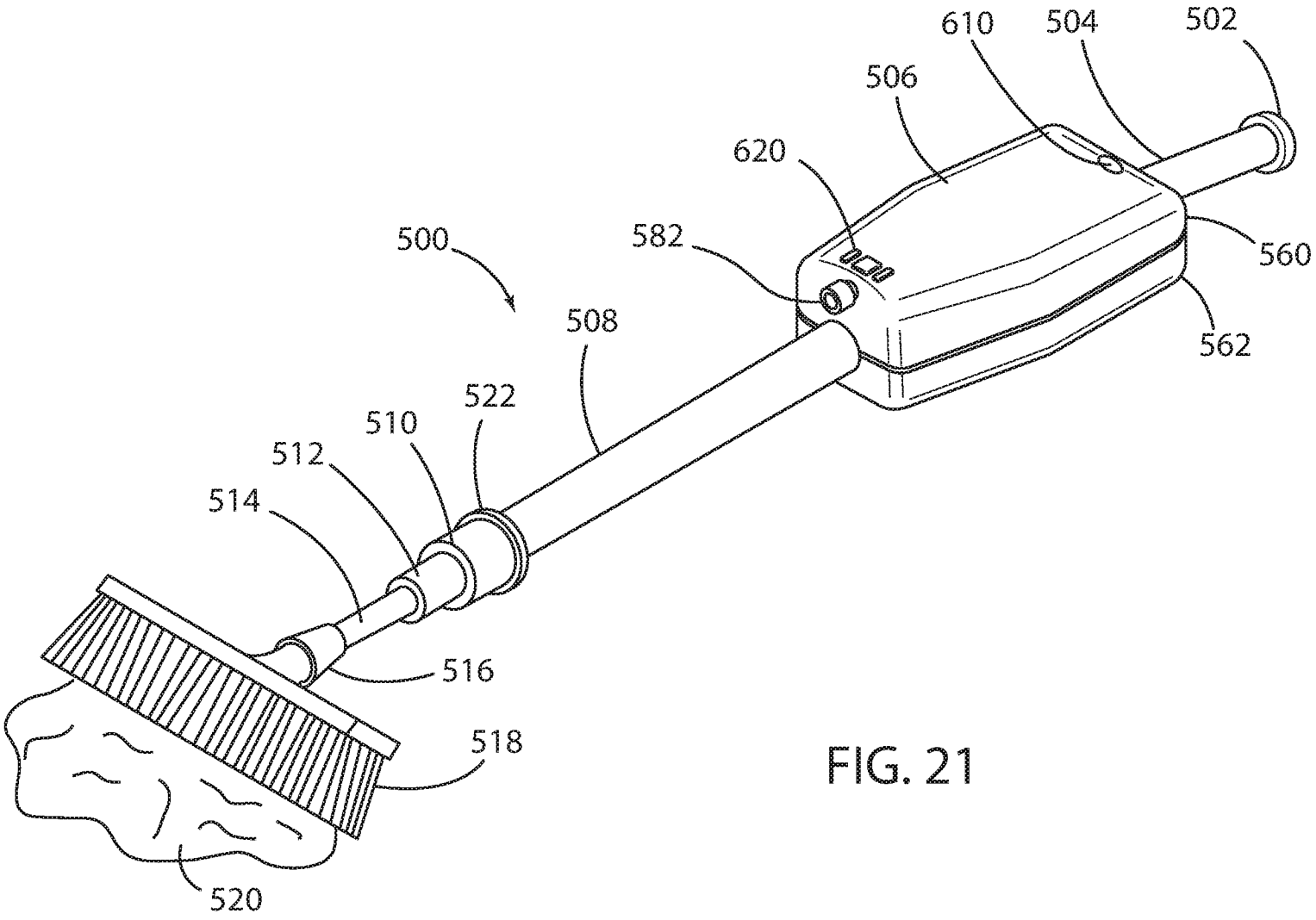
FIG. 21 is a perspective view of an exemplary approach of the embodiments of the present portable foam brush wand.
Figure 22:
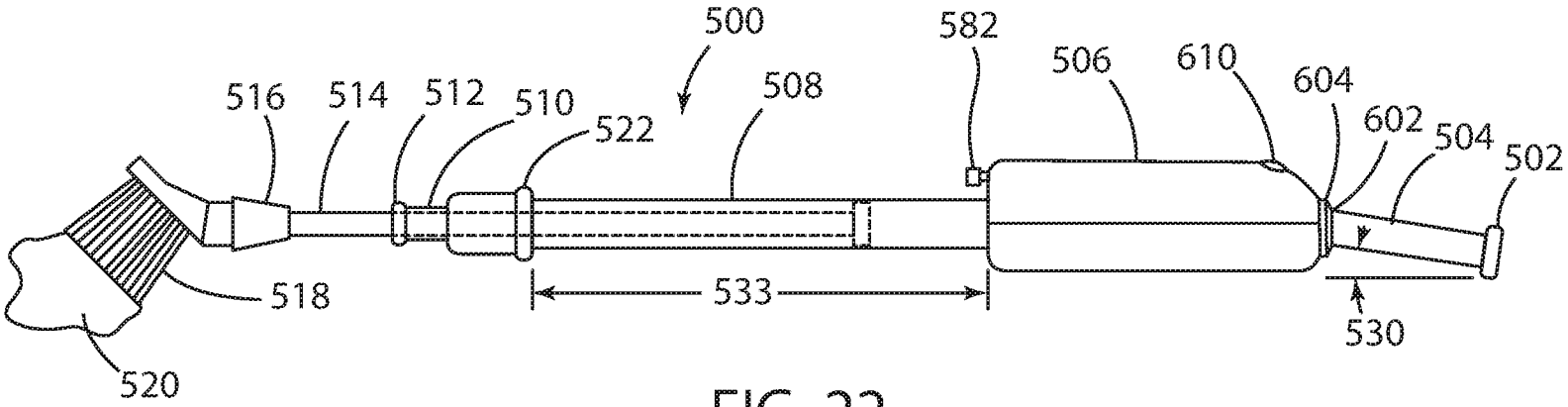
FIG. 22 is a side view of an exemplary approach of the embodiments of the present portable foam brush wand of FIG. 21.
Figure 23:
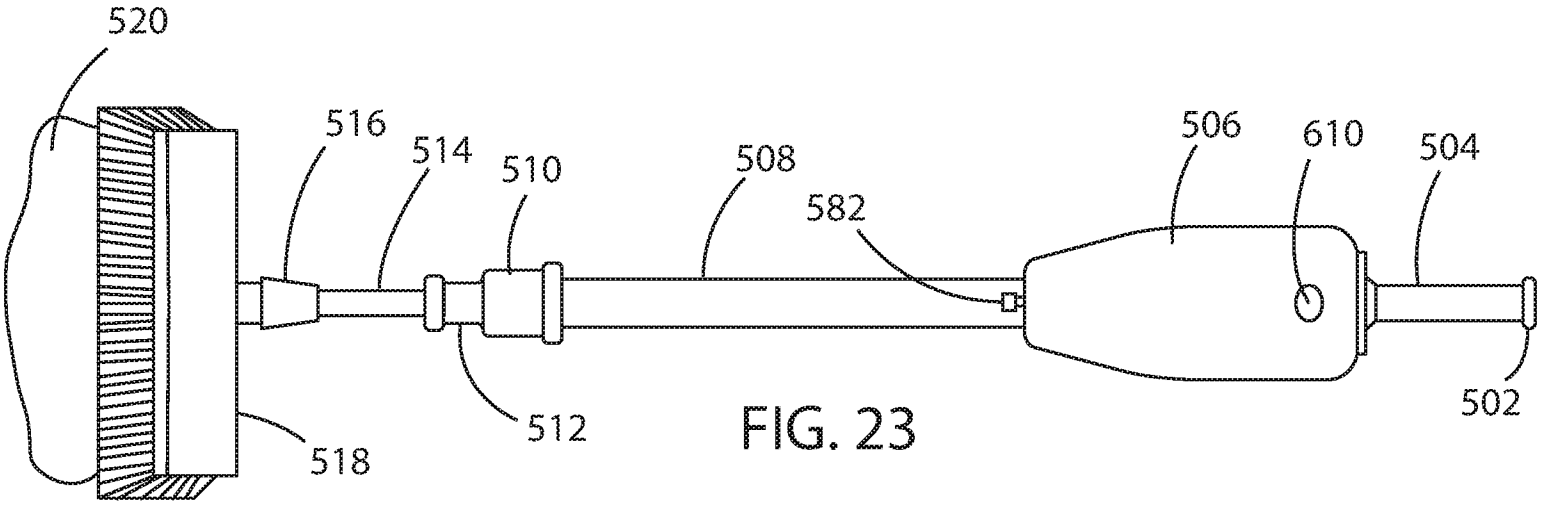
FIG. 23 is a top view of an exemplary approach of the embodiments of the present portable foam brush wand of FIG. 21.
Figure 27:
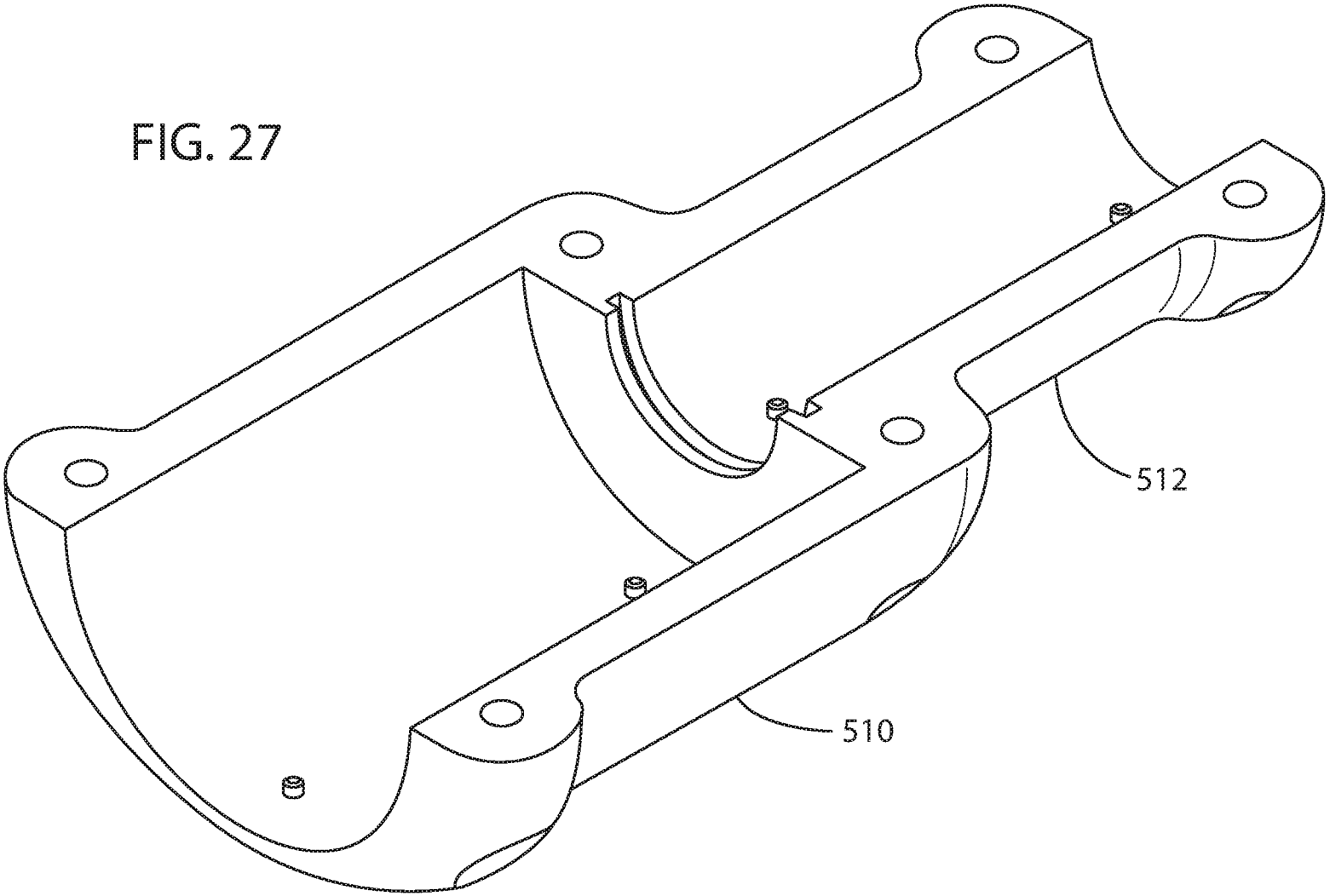
FIG. 27 is a perspective view cutaway view of an exemplary approach of the embodiments of the present portable foam brush wand first and second wand connector 510.

FIGS. 21-23 shows an exemplary foam brush wand assembly 500 according to an alternate approach diagrammed in FIGS. 18-20 where the soap reservoir and other components are housed in a separate base described below. In this embodiment, the weight of the wand assembly is considerably lighter given that the main components are simply the housing, wand sections, brush, hoses, air compressor, battery and foaming chamber. In this embodiment, foam 520 is generated as described herein and exits the wand sections 514 and 508 into brush 518. Foam brush wand assembly 500 has connector 516 to connect extendable wand section 514 to brush 518. Connector 510 connects extendable wand section 514 with base wand section 508. Connector 510 has a narrow section 512 to allow wand section 514 to slide into base section 508 and a collar 522. Base section 508 also houses the foaming chamber as described herein. See also, FIG. 27 showing one half of a split connector.

Foam brush wand assembly 500 also has a foam brush base 506 having quick connect connector 582 to receive the soap and water mixture from base stand 400 as described below. Foam brush base 506 also has electrical terminals 620 to charge the battery when docked in the base stand 400. Foam brush base 506 also can be into upper and lower portions 560 and 562 respectively. In use a user holds foam brush wand assembly 500 by handle 504, which can have an option gripping collar 502 to allow better control of foam brush wand assembly 500. Handle 504 can have optional foam padding and can oriented at a downward angle from the axis of the wand sections by angle 530 in FIG. 22. Angle 530 can be about 5-15 degrees and preferable about 8-10 degrees off the longitudinal axis.

Figure 24:
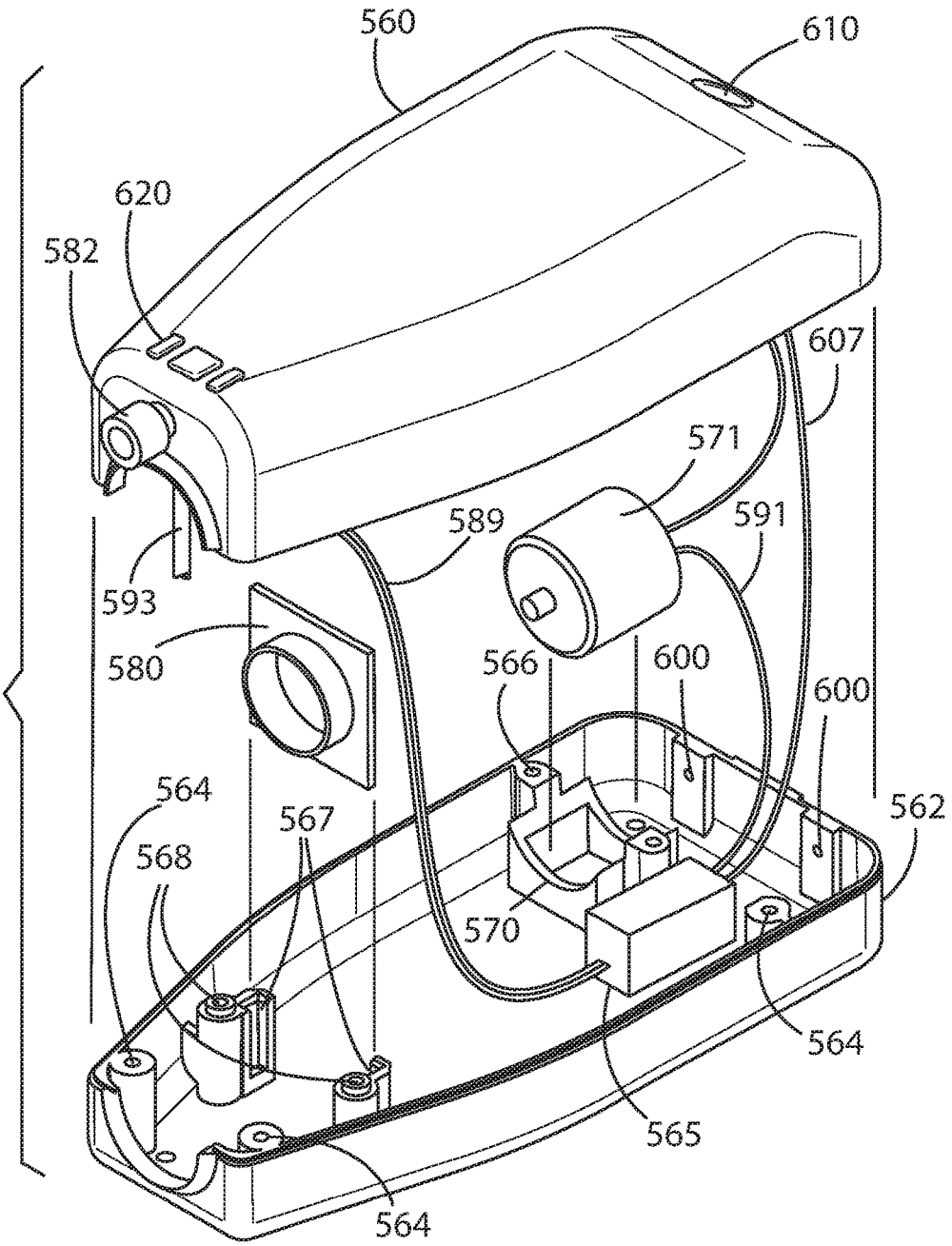
FIG. 24 is an exploded perspective view of an exemplary approach of the embodiments of the present portable foam brush wand base 560.

As shown in exploded view of FIG. 24 of base 560, a bracket 580 connect wand 508 to base 560 attaching a opening 599. Bracket 580 can be disposed in slide brackets 567. Base 560 in this embodiment also houses an electric fan 571 connected to battery 565 via lines 591, which is charged via electrical lines connected to electrical terminals 620 via line 589. Battery 565 can be held in place by a bracket or foamed in. Electric fan 571 is activated by user operated switch 610 and completes the circuit with batters 565 via line 607. Base 560 also has a switch 610 to complete the circuit to activate the fan motor 571 to generate foam from the soap water mixture received from the base stand via connecter 582 and fed into a foaming chamber via hose 593. Motor 571 can be held in place via connectors 566 into cradle 570. Base 560 sections 560 and 562 can be joined with connectors such as screws and the like at 565 and 568. Handle 504 can be connected to base 560 using connectors, such as screws at 600. See, FIG. 25 screw holes 602.

Figure 28:
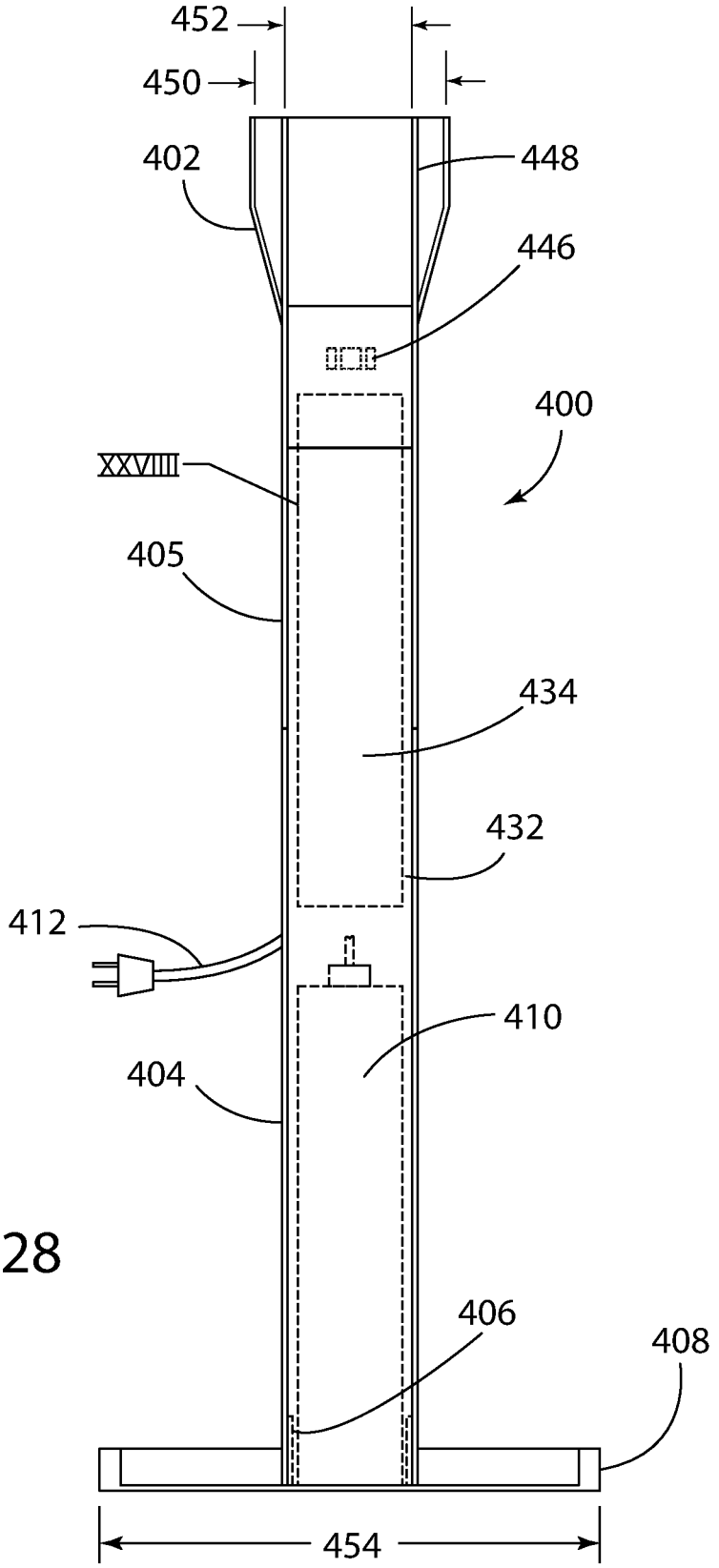
FIG. 28 is a rear elevational view of a brush base stand according to an exemplary approach of the embodiments of the present portable foam brush.
Figure 39:
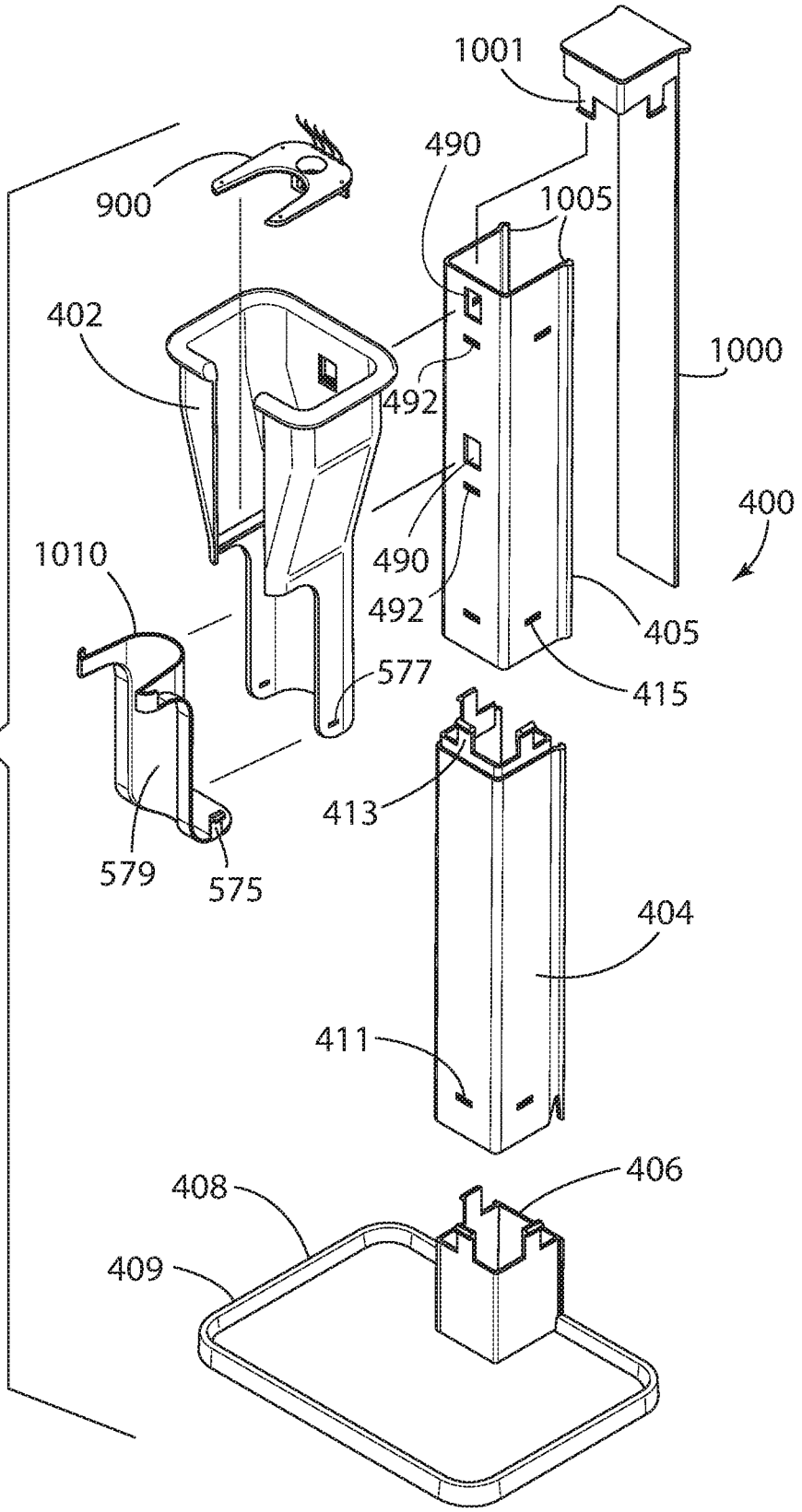
FIG. 39 is an exploded perspective view of an exemplary approach of the embodiments of the present portable foam brush wand base.

FIGS. 28-40 illustrate various embodiments of a foam brush stand 400 to hold foam brush 500. For example, FIG. 28 shows a front elevational view of a brush base stand according to one approach of the present portable foam brush assembly. As shown, stand 400 can have a base 408 to provide support for stand 400 and foam brush 500 as well as well as provide a drip pan 433 (FIG. 30) to contain drips from the foam brush when docked in the base after use by retaining lip 409 (FIG. 39). Ribs 435 can also be added to base 408 for added stability and strength and also to contain drips from the docked foam brush after use. Accordingly, the dimensions of the base should be sufficient to provide a stable stand that avoids tip over during normal use. Further, the dimensions of base 400 should be sufficient to extend beyond the width of the foam brush 518 and beyond where the foam brush is oriented off the stand when docked. As shown in FIGS. 30 and 39, base 400 also has a base bracket 405 having tabs 409 to fasten first stand section 404 using tabs 409 to flex then extend into opening 411 of first stand section 404. Similarly, tabs 413 of first stand section 404 flex then extend into openings 415 of second stand section 405 during assembly. First stand section 404 also has a recess 1007 to conform to the shape of lip 408 in base 408. Accordingly, the material used to construct the base stand should provide some flexibly to be sufficiently pliable and resilient to bend during insertion of the attached section into the next upward section then extend into the matching opening to provide a secure connection that can be detached by pushing the tab end back into the inside of the section. Plastics and composites are preferred given its relatively low expense and weight, while providing sufficient strength to support the wand and its components.

Additional base foam brush stand 400 structural components can include an upper cover 1000 having tabs 1001 configured to extend into openings 1003 of second stand section 405. Upper cover 1000 is installed by sliding down through grooves 1005 (FIG. 39) of first and second stand sections. Accordingly, upper cover 1000 can be long enough to also extend into first stand section 404. This configuration adds strength and rigidity to the stand overall and especially to the connection of first base stand 404 to second base stand 405.

Figure 33:
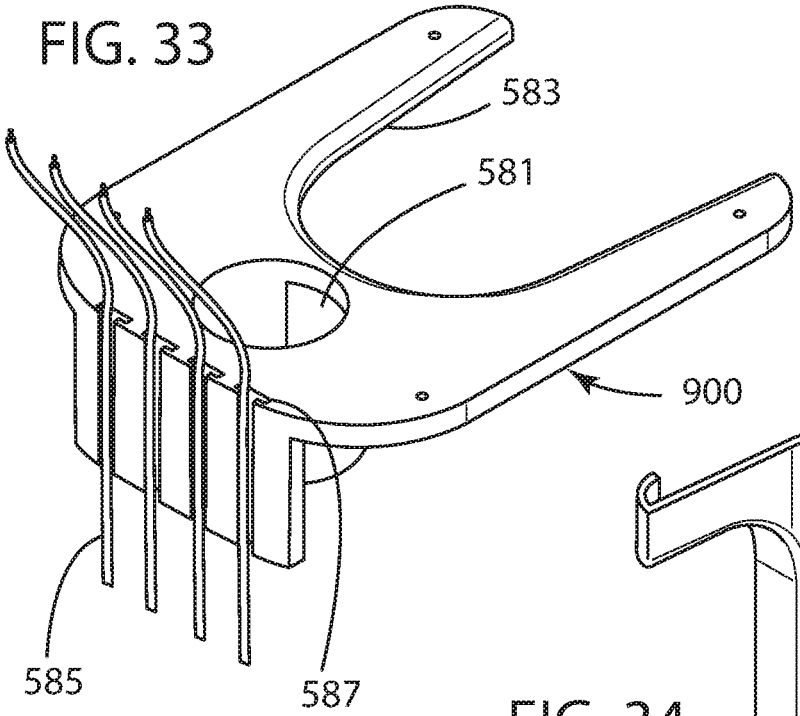
FIG. 33 is a top perspective view of bracket 900 of the upper stand portion according to an exemplary approach of the present embodiments.
Figure 34:
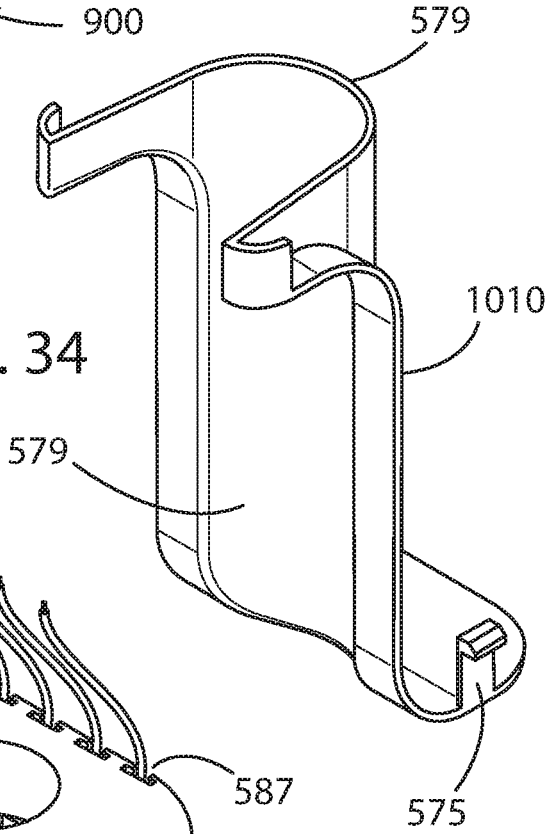
FIG. 34 is a top perspective view of bracket 1000 of the upper stand portion according to an exemplary approach of the present embodiments.
Figure 35:
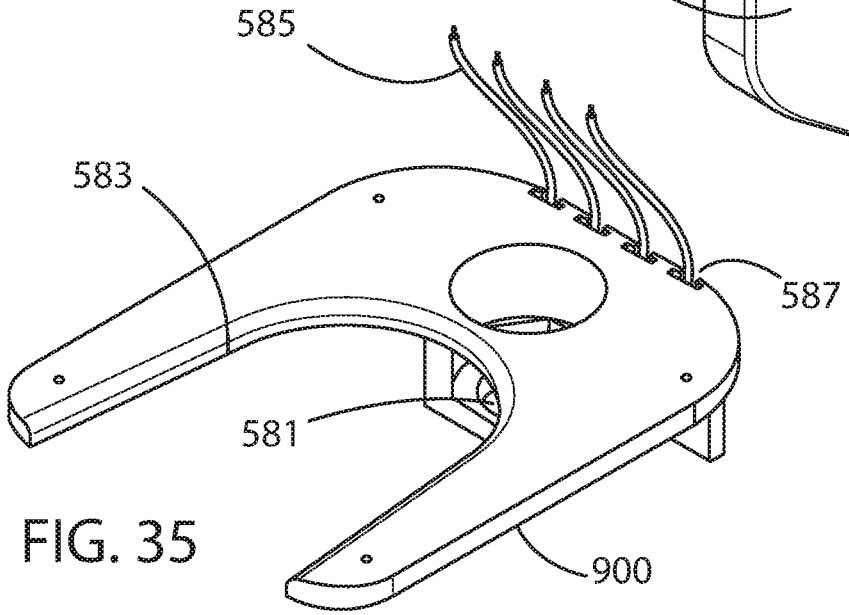
FIG. 35 is a top perspective view of bracket 900 of the upper stand portion according to an exemplary approach of the present embodiments.
Figure 36:
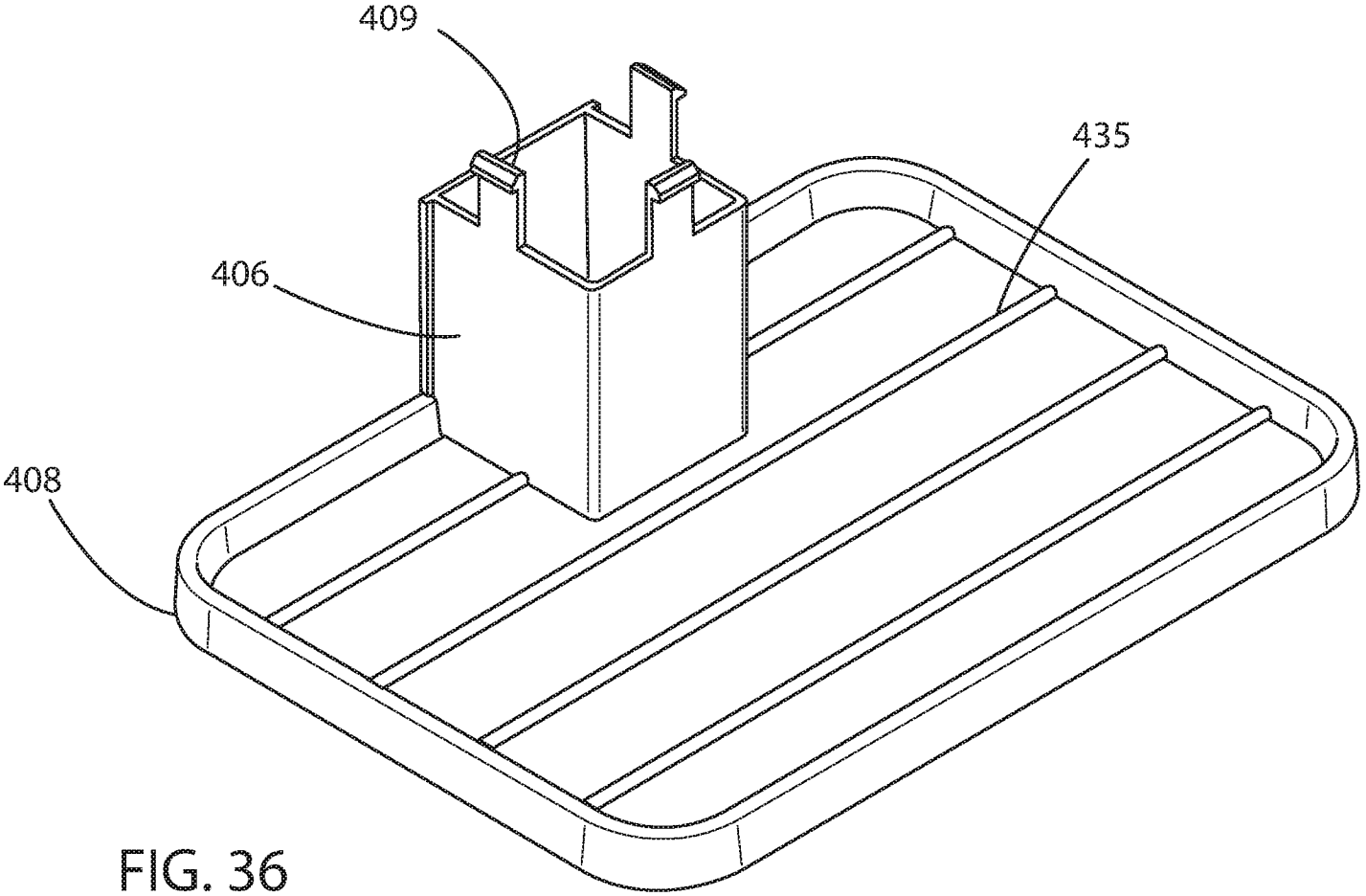
FIG. 36 is a top perspective view of base 408 of the stand according to an exemplary approach of the present embodiments.
Figure 37:
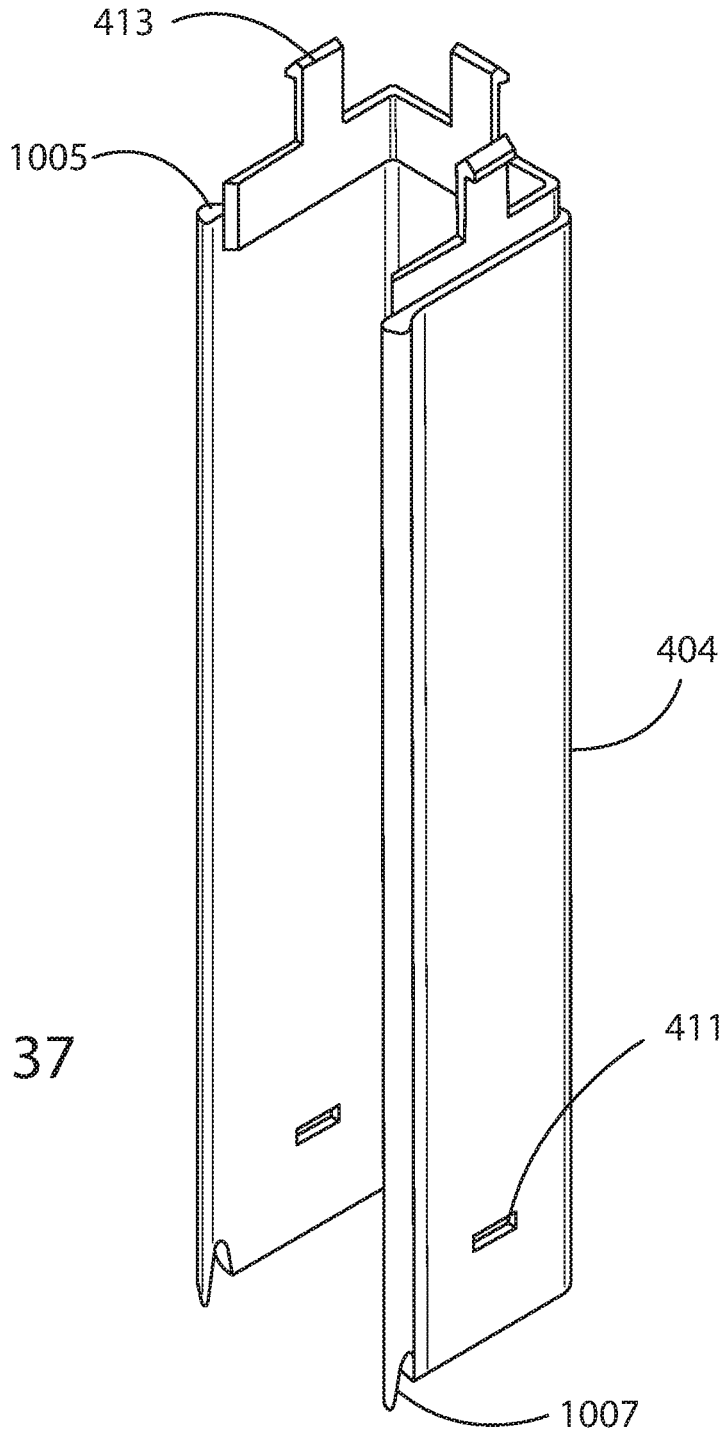
FIG. 37 is a top perspective view of lower stand section 404 of the stand according to an exemplary approach of the present embodiments.
Figure 38:
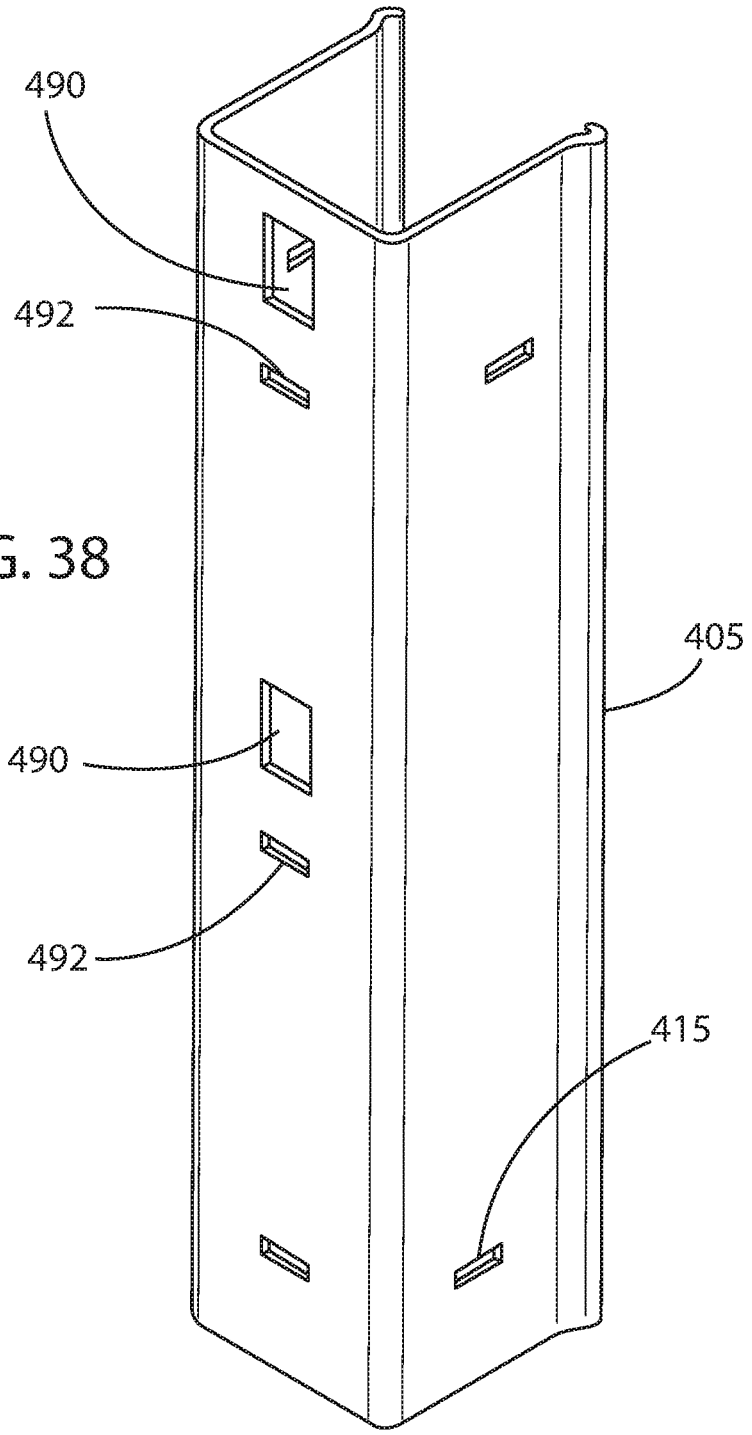
FIG. 38 is a top perspective view of lower stand section 404 of the stand according to an exemplary approach of the present embodiments.

Foam brush stand 400 additionally has a foam brush docking bracket 402 having additional support pieces 1010 and 900 (see FIGS. 33-34). Support piece 900 connects above support sleeve 1010 within docking bracket 402. Support sleeve 1010 helps to cover the interior portions of docking bracket 402 and connects via its tabs 575 into slots 577 of docketing bracket 402. Arc 579 of support sleeve 1010 is large enough to receive wand section 508. Support piece 900 connects to the top of support sleeve 1010 and docking bracket 402 as shown in FIG. 39. As shown in FIGS. 33 and 35, support piece 900 has grooves 587 to allow for wires 587 to extend into docking bracket to attached to terminals 446 (See, FIG. 28) to contact terminals 620 (See FIG. 21) of the foam brush wand 500 when docked. Support piece 900 also has and arc 583 conforming to arc 579 of support sleeve 1010. Support piece 900 also has a reciprocating quick connect connection 581 to provide a fluid connection to the foam brush wand 500 at connection 582 (See, FIG. 21).

Docking bracket 402 also has an opening 816, which is sized to slightly exceed the diameter of wand section 508 when docked. Tabs 551 (FIGS. 31 and 31A) are sized to pass through opening 490 in stand piece 405 than to slide downward until extending into slots 492. (See FIG. 38) Docking bracket 402 also is sized to receive foam brush base 506 and to automatically connect to the fluid and electrical connections 582 and 620 respectively for the foam brush and 581 and 446 for the base stand respectively. For example, according to one embodiment shown in FIG. 28, dimension 450 can be about 4.79 inches and dimension 452 can be about 3.25 to receive a wand base 506 that is less than 4.79 inches, such as 4.75 to 4.5 inches. As also shown in FIG. 28, dimension 454 should exceed the width of foam brush 518 and depth dimension 456 (FIG. 30) to also be completely under the brush when docked. For example, it can exceed the width of foam brush 518 by about 2 to 6 inches so long as overall stability of the platform is maintained. FIG. 28 also shows a typical electrical connection 412, which can be 110 V or 220 volt. FIG. 28 also shows the soap reservoir 410.

Figure 29:
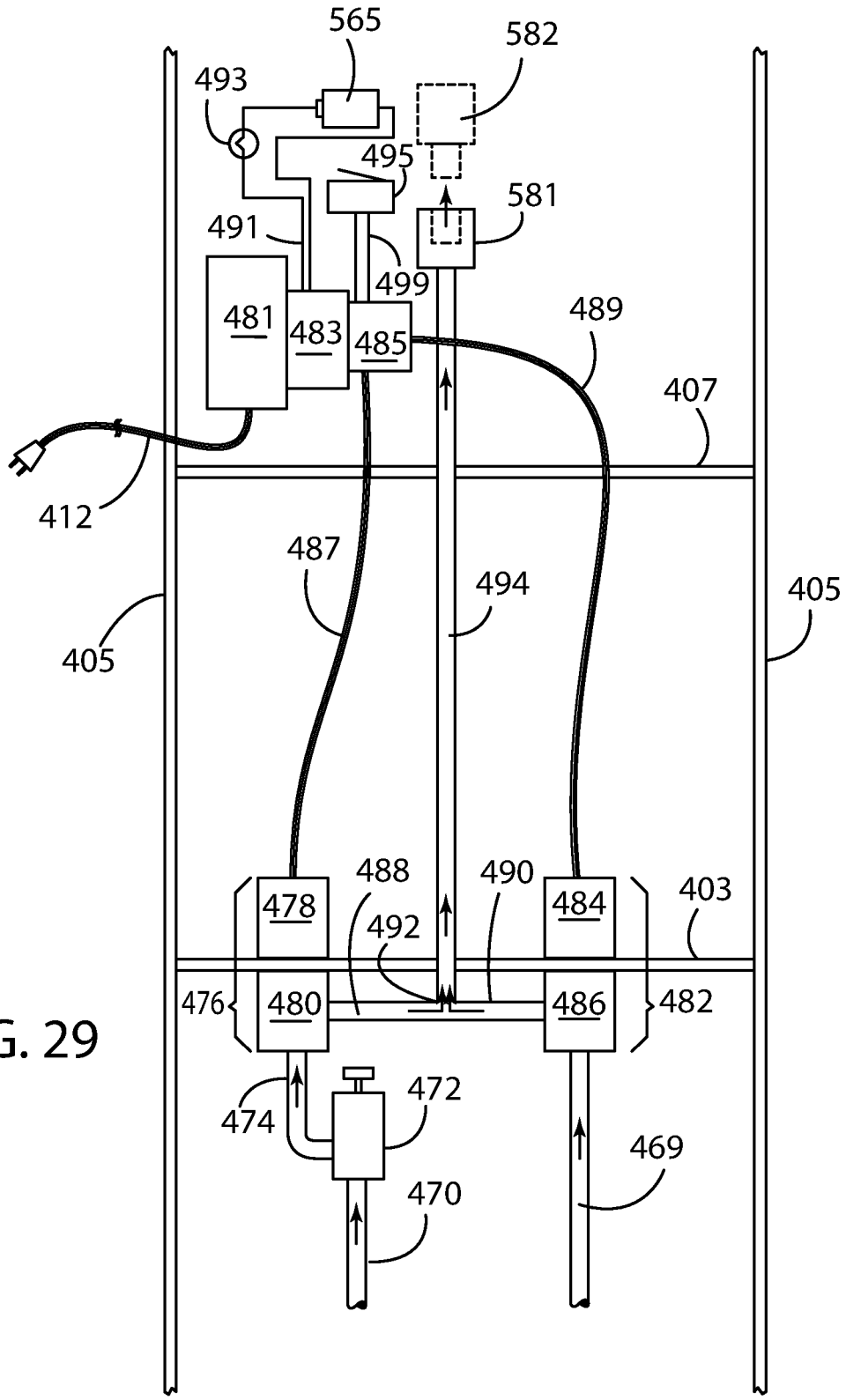
FIG. 29 is a rear elevational view of a brush base stand according to an exemplary approach of the embodiments of the present portable foam brush disposed within section XXVIII of FIG. 28.
Figure 30:
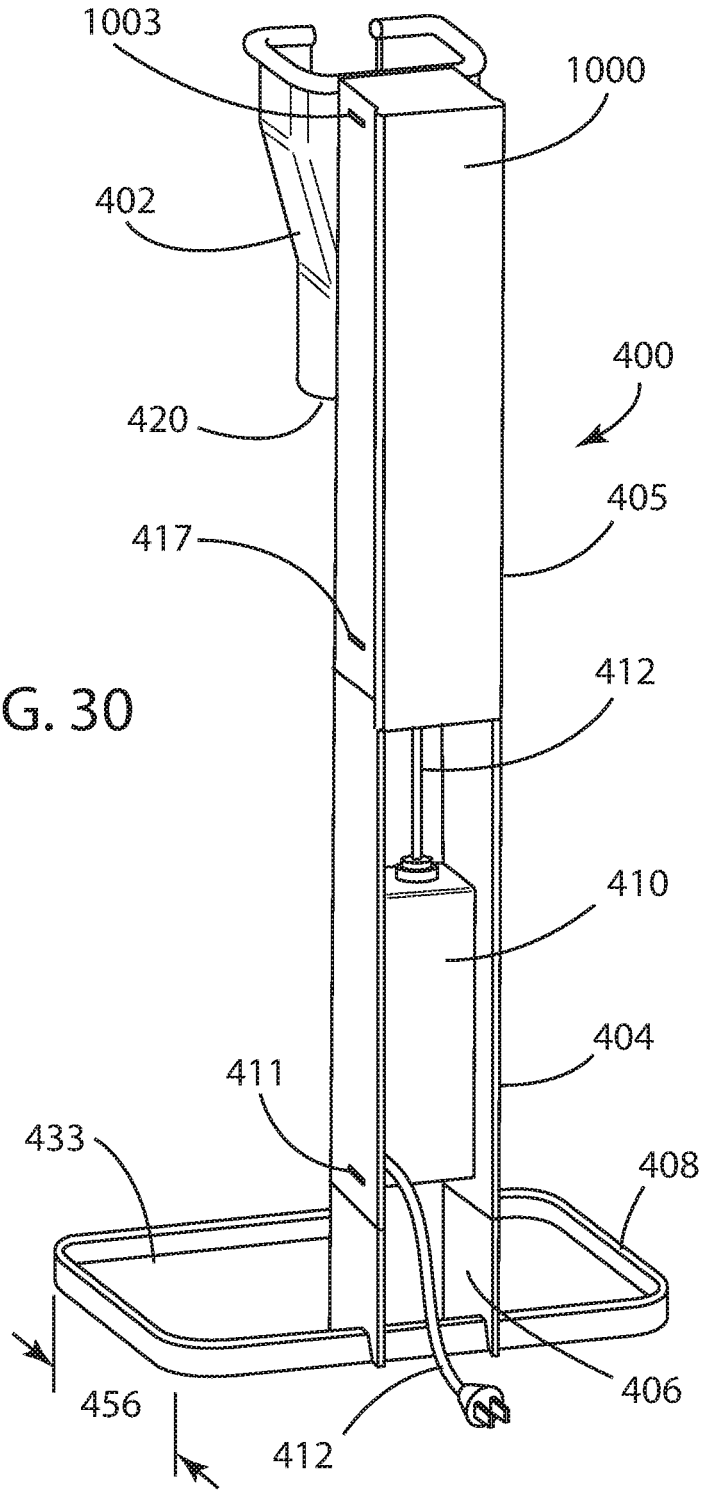
FIG. 30 is a rear perspective view of a brush base stand according to an exemplary approach of the embodiments of the present portable foam brush.
Figures 31, 31A:
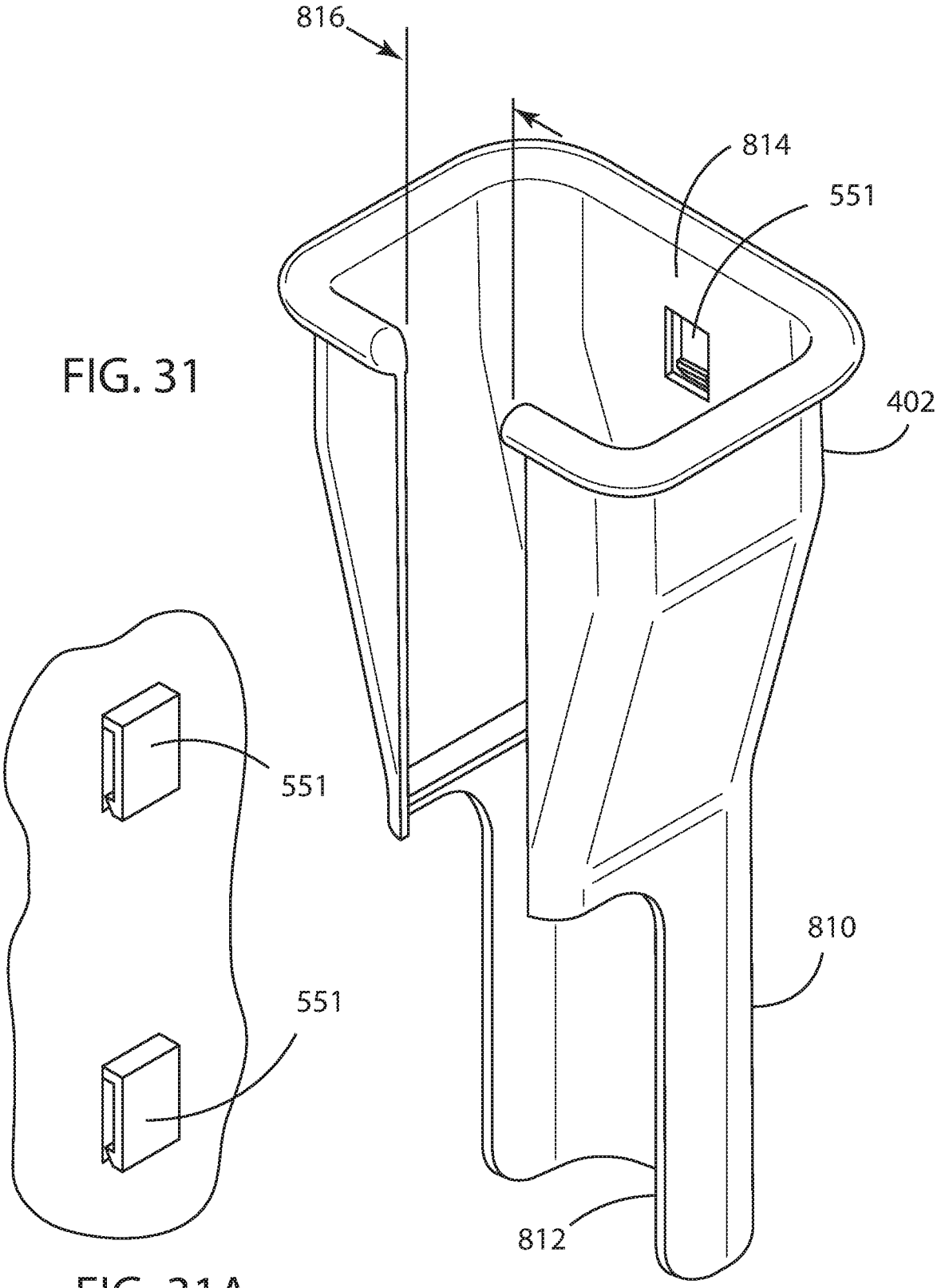
FIG. 31 is a front perspective view of a base stand foam brush docking bracket according to an exemplary approach of the embodiments of the present portable foam brush.
FIG. 31A is a rear perspective view of a portion of the base stand foam brush docking bracket according to an exemplary approach of the embodiments of the present portable foam brush showing the attachment tabs to the upper section of the base stand.
Figure 32:
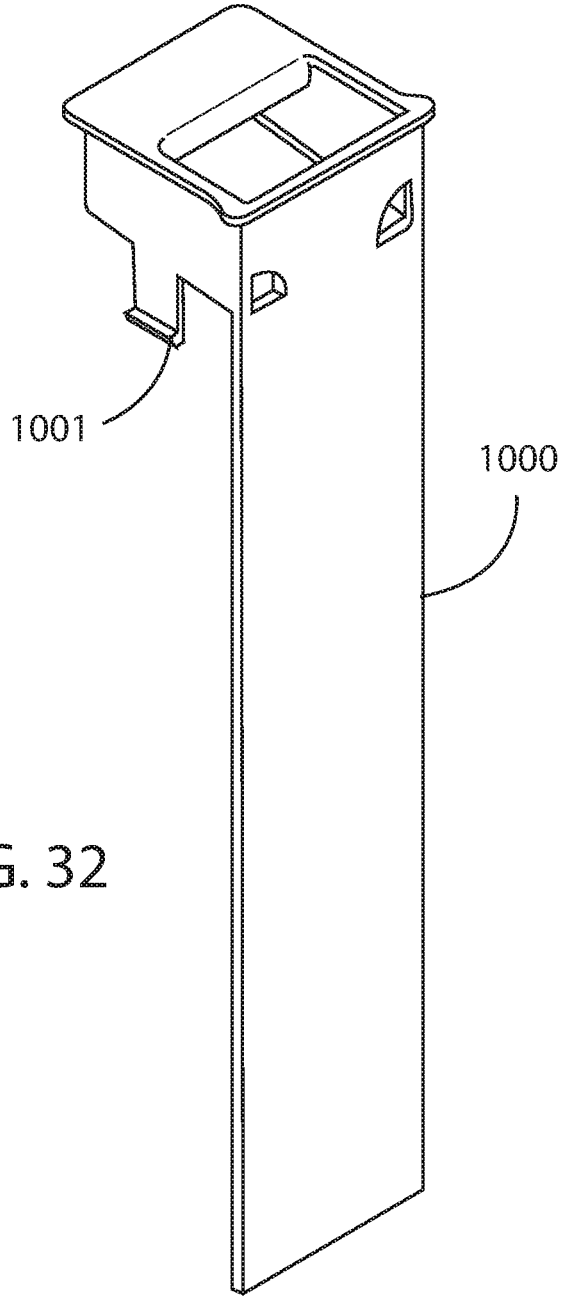
FIG. 32 is a rear perspective view of a rear cover of the upper stand portion according to an exemplary approach of the present embodiments.

FIG. 29 is a rear elevational view of a brush base stand according to an exemplary approach of the embodiments of the present portable foam brush disposed within section XXVIII of FIG. 28 showing details of the components within base stand section 405. As shown, base stand section has partitions 403 and 407 to add rigidity to stand section 405 and at least in the case of partition 403, electrical and water components are separated. As shown in FIG. 29, as well as in FIG. 39, the foam brush base stand can be assembled and disassembled by a user by simply snap fitting the base, stand and dock together prior to use. This assembled configuration allows for easier mold production of the assembly pieces as well as minimizing packaging for delivery of the system to a user.

As shown in FIG. 29, portions of the foam brush unit in this embodiment are disposed within the base stand 400 to reduce weight of the foam brush wand 500. Other alternative differences include the use of a peristaltic pump when combined with the water pressure from the water supply drive a soap water mixtures into the foam brush wand 500 where with the aid of fan pump 571 generates foam that travels through the wand sections 508 and 514, then out at brush 518 as shown in FIG. 21. Thus the weight of soap reservoir in the wand is eliminated.

Accordingly, as shown in FIG. 29, hose 470 is connected to a water supply. This connection can be a typical garden hose connection or alternately a water pump (not shown) to generate static water to the desired pressure. Frequently, city water supplies and well pumps can be set to deliver water at about 60-80 PSI. The preferred water pressure for the illustrated embodiment is about 20-25 PSI. Accordingly, a water pressure reducer 472 coverts the water pressure to this desired pressure and delivers it to valve assembly 476 having a valve 480 operable via a solenoid 478. Valve 480 and solenoid 478 are preferably separated by partition 403. When valve 480 is opened, water travels via hose 488 to tee 492 then up hose 494 to connector 581 to ultimately connect to the foam brush wand via its connector 582.

Hose 469 connects to soap reservoir 410 (see FIG. 28). Soap is drawn into the hose via a pump, such as a peristaltic pump assembly 482 having pump 486, driven by an electric motor 484. As with the solenoid, the motor 484 and pump are separated by partition 403. While pump 486 is operating, soap is drawn out of the reservoir and a predetermined rate/speed to travel via hose 490 to tee 492 to also then travel up hose 494 with the water from hose 488 to connector 581 to ultimately connect to the foam brush wand via its connector 582. The water pressure and pump speed are predetermined to mix the soap and water to the desired concentration. This determinations are based on the concentration of the soap from the soap reservoir and ultimately the desired amount of foaming out of the wand 500.

Above partition 407, AC power via cord 412 can be delivered to an AC to DC transformer 481. If DC power is delivered to the system, such as from a vehicle DC source, transformer 481 would not be needed. However, a voltage converter may be needed for a system delivering a different DC voltage than used by the system of the foam brush assembly. One the proper DC voltage is generated, the current is delivered to charger 483, which is connected to a timer 485. Timer 485 as shown is activated by user operated switch 495 via line 499. Timer 485, when activated, opens solenoid 478 and pump 484 to allow the soap and water to mix and travel to the foam brush wand. Typically, the timer can be set to run for about 20 seconds. Timer 485 can also be controlled by a kill switch to only operate when the wand is docked in the base. The timer is set by the duration of time needed to fill the bladder of the foam brush wand with enough soap/water to generate foam for a predetermined period of time, such as 2-5 minutes of foam generation when the wand is undocked and activated by switch 610. It is also noted that switch 610 can also be optionally connected to a kill switch to prevent activation when docked.

When pressure wand 500 is docked in the base stand, charger 483 can also connect to the wand base's batter 565 via line 491 having a status light 493 to show the system is charging. As described above, line 491 connects to battery 565 via base terminal 446 to wand base terminals 620.

FIGS. 40 and 41 illustrate a front perspective view of a brush base stand according to another exemplary approach of the embodiments of the present portable foam brush. In this embodiment all the aforementioned components of base stand section 404 and 405 are contained within a box 497. Docketing bracket 402 attaches to box 497 with the physical, electrical and fluid connections as described within base stand sections 404 and 405 as described herein. Alternately, box 497 can be directly mounted to a wall 501 or via a stand 489 and pad 408 shown in FIG. 41.

Figure 42:
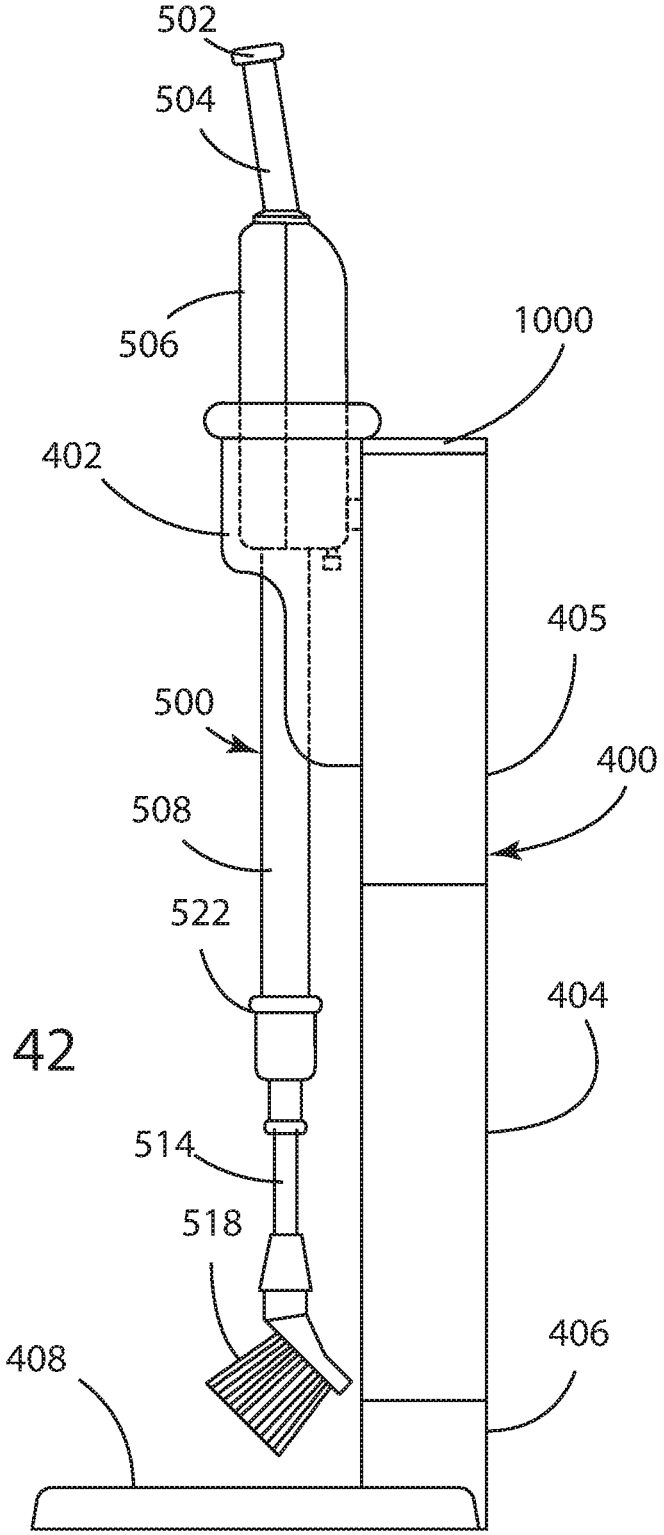
FIG. 42 is a side view of the foam brush 500 docked in base 400.

FIG. 42 is a side view of the foam brush 500 docked in base 400.

While preferred embodiments have been described in detail, variations and modifications can be effected within the configurations described herein. It will be understood that many of the described features of the portable foam brushes can be interchanged with each other to create alternative brushes. For example, the various soap filling valve assemblies, and details thereof, can be interchanged.

The invention claimed is:

1. A portable foam brush comprising:

a soap reservoir; a foaming chamber; a battery-operated air compressor configured for supplying air to act upon the soap reservoir to cause dispensing of soap from the soap reservoir to the foaming chamber and independently supplying air to the foaming chamber whereby, in use, the soap and the air in the foaming chamber combine to form a foam; and a brush end configured for receiving foam from the foaming chamber and dispensing the foam; and wherein the soap reservoir has a movable piston dividing the reservoir into a chamber for containing soap and an actuation chamber, the actuation chamber being configured to be acted upon by air from the air compressor for moving the piston to decrease the size of the chamber for containing soap to thereby dispense soap therefrom.

2. The portable foam brush of claim 1, wherein the air compressor supplies air to act upon the soap reservoir via a soap reservoir air path and the air compressor supplies air to the foaming chamber via a foaming chamber air path, the soap reservoir and foaming chamber air paths having portions that are independent.

3. The portable foam brush of claim 2, wherein the foaming chamber air path is disposed exteriorly of the soap reservoir.

4. The portable foam brush of claim 2, wherein the foaming chamber air path has a segment extending through the soap reservoir.

5. The portable foam brush of claim 4, wherein the segment of the foaming chamber air path extends at least in part in a conduit extending through a chamber for containing soap and an actuation chamber.

6. The portable foam brush of claim 5, wherein the conduit extends through an aperture in the moveable piston.

7. The portable foam brush of claim 2, wherein the foam chamber air path includes an adjustment valve for adjusting the amount of air delivered to the foaming chamber.

8. A portable foam brush comprising:

a soap reservoir; a foaming chamber; a battery-operated air compressor configured for supplying air to act upon the soap reservoir to cause dispensing of soap from the soap reservoir to the foaming chamber and independently supplying air to the foaming chamber whereby, in use, the soap and the air in the foaming chamber combine to form a foam; and a brush end configured for receiving foam from the foaming chamber and dispensing the foam; and wherein a soap reservoir filling valve assembly is provided between the soap reservoir and the foaming chamber, the soap reservoir filling valve assembly having a filling mode, whereby soap can be introduced into the soap reservoir and is blocked from entering the foaming chamber, and a dispensing mode, whereby soap can be dispensed from the soap reservoir into the foaming chamber.

9. The portable foam brush of claim 8, wherein air flow from the air compressor to the foaming chamber is blocked when the soap reservoir filling valve assembly is in the filling mode and air flow from the air compressor to the foaming chamber is permitted when the soap reservoir filling valve assembly is in the dispensing mode.

10. The portable foam brush of claim 9, wherein an air vent of the soap reservoir filling valve assembly is in an open position when the soap reservoir filling valve assembly is in the filling mode to permit surplus air to vent from the soap reservoir and the air vent is in a closed position when the soap reservoir filling valve assembly is in the dispensing mode.

11. The portable foam brush of claim 8, wherein a fill valve of the flow of soap into and out of the soap reservoir is provided between the soap reservoir and the foaming chamber.

12. The portable foam brush of claim 11, further comprising an air vent for venting of air from the soap reservoir.

13. The portable foam brush of claim 1, wherein a fill valve of the flow of soap into and out of the soap reservoir is provided between the soap reservoir and the foaming chamber.

14. The portable foam brush of claim 13, further comprising an air vent for venting of air from the soap reservoir.

15. The portable foam brush of claim 1, wherein a brush bristle assembly is attached to the brush end for receiving foam from the foaming chamber and dispensing the foam.

16. The portable foam brush of claim 1, further comprising a disconnectable recharging station for recharging of a battery associated with the battery-operated air compressor in order to permit cordless electrical operation of the brush.

17. The portable foam brush of claim 1, further comprising a disconnectable soap refilling station configured for filling the soap chamber with soap in order to permit hoseless fluid operation of the brush.

18. A portable foam brush comprising:

a hand held foam brush wand assembly comprising a soap reservoir; a foaming chamber; a battery-operated air compressor configured for supplying air to act upon the soap reservoir to cause dispensing of soap from the soap reservoir to the foaming chamber and independently supplying air to the foaming chamber whereby, in use, the soap and the air in the foaming chamber combine to form a foam; and a brush end configured for receiving foam from the foaming chamber and dispensing the foam.

* * * * *